US006736482B1

(12) United States Patent
Suzuki

(10) Patent No.: US 6,736,482 B1
(45) Date of Patent: May 18, 2004

(54) LIQUID JETTING APPARATUS

(75) Inventor: Kazunaga Suzuki, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 505 days.

(21) Appl. No.: 09/689,761

(22) Filed: Oct. 13, 2000

(30) Foreign Application Priority Data

Oct. 13, 1999 (JP) ..... 11-291627

(51) Int. Cl.[7] ..... B41J 2/165

(52) U.S. Cl. ..... 347/23; 347/29; 347/30; 347/35

(58) Field of Search ..... 347/23, 14, 19, 347/22, 24, 27, 29, 30, 35

(56) References Cited

U.S. PATENT DOCUMENTS

| | | | | |
|---|---|---|---|---|
| 5,459,496 A | | 10/1995 | Hanabusa et al. | 347/5 |
| 5,495,271 A | * | 2/1996 | Koitabashi et al. | 347/23 |
| 5,572,242 A | * | 11/1996 | Fujii et al. | 347/23 |
| 5,617,122 A | | 4/1997 | Numata et al. | 347/14 |
| 5,625,384 A | * | 4/1997 | Numata et al. | 347/23 |
| 5,757,396 A | | 5/1998 | Bruner | 347/27 |
| 5,850,237 A | | 12/1998 | Slade | 347/23 |
| 6,036,299 A | * | 3/2000 | Kobayashi et al. | 347/30 |
| 6,042,218 A | * | 3/2000 | Nakahara | 347/35 |
| 6,193,351 B1 | * | 2/2001 | Yaegashi et al. | 347/23 |
| 6,398,336 B1 | * | 6/2002 | Yoda et al. | 347/23 |

FOREIGN PATENT DOCUMENTS

| | | |
|---|---|---|
| EP | 11157102 | 6/1999 |
| JP | 5-92579 | 4/1993 |
| JP | 5-318718 | 12/1993 |
| JP | 7-47696 | 2/1995 |
| JP | 7-266576 | 10/1995 |
| JP | 9-29996 | 2/1997 |

* cited by examiner

*Primary Examiner*—Shih-Wen Hsieh
(74) *Attorney, Agent, or Firm*—Wenderoth, Lind & Ponack, L.L.P.

(57) ABSTRACT

A liquid jetting apparatus of the invention includes a head having a nozzle. The head is adapted to receive jetting data corresponding to one scanning movement in a main scanning direction. The head is moved in the main scanning direction, after the head has received the jetting data. A suitable viscosity of liquid in the nozzle is recovered from an increased viscosity thereof by operating a recovering unit. A measuring timer is adapted to measure at least a part of the time since a previous operation of the recovering unit has been completed. A controller is adapted to control the recovering unit based on the time measured by the measuring timer.

32 Claims, 10 Drawing Sheets

LIQUID JETTING APPARATUS

FIELD OF THE INVENTION

This invention relates to a liquid jetting apparatus having a head capable of jetting a drop of liquid from a nozzle. In particular, this invention is related to a liquid jetting apparatus that can prevent the viscosity of liquid in a nozzle of a head from increasing.

BACKGROUND OF THE INVENTION

In an ink-jetting recording apparatus such as an ink-jetting printer or an ink-jetting plotter (a kind of liquid jetting apparatus), a recording head (head) can be moved in a main scanning direction, and a recording paper (a kind of recording medium) can be moved in a sub-scanning direction perpendicular to the main scanning direction. While the recording head is moved in the main scanning direction, a drop of ink can be jetted from a nozzle of the recording head onto the recording paper. Thus, an image including a character or the like can be recorded on the recording paper. For example, the drop of ink can be jetted by changing pressure of the ink in a pressure chamber communicating with the nozzle.

The pressure of the ink may be changed by utilizing a pressure-generating member, for example a piezoelectric vibrating member. In such a case, the piezoelectric vibrating member can be deformed based on a supplied driving-pulse in order to change a volume of the pressure chamber. When the volume of the pressure chamber is changed, the pressure of the ink in the pressure chamber may be changed. Then, the drop of ink is jetted from the nozzle.

The ink in the nozzles of the recording head is exposed to air. Thus, a solvent of the ink, such as water, may gradually evaporate to increase the viscosity of the ink in the nozzle. In that case, the quality of recorded images may deteriorate because ink having a great viscosity may be jetted in a direction that deviates from the normal direction.

To prevent the viscosity of the ink in the nozzles from increasing, some measures have been proposed. One of the measures is to forcibly cause ink having an increased viscosity to jet out from the nozzle outside an objective recording area (a flushing operation). Another one of the measures is to cause a meniscus of the ink to minutely vibrate to stir the ink (a stirring operation). The meniscus means a free surface of the ink exposed at an opening of the nozzle.

The execution amount of such a maintenance operation (the flushing operation, stirring operation or the like) may be set suitably for the quality of images recorded in the objective recording area in order to ensure the quality even at a position in the objective recording area furthest away from a waiting position of the recording head.

However, in the recording apparatus for printing onto a recording paper having a larger size, such as a trimmed B-0 size (1030 mm×1456 mm:JIS P 0138), a distance for which the recording head is moved in the main scanning direction is very long. Thus, when a flushing operation is conducted as a maintenance operation, the volume of the ink jetted from the nozzle in the flushing operation is set to be large in order to ensure that a first drop of ink can be normally jetted even when the first drop of ink is jetted at the position in the objective recording area furthest away from the waiting position of the recording head. Similarly, when a minutely-vibrating (stirring) operation is conducted as a maintenance operation, the number of operations (vibrations) of the pressure-generating member is set to be large.

Thus, if the flushing operation is conducted in the recording apparatus, as the volume of the ink jetted in the flushing operation is large, the volume of the ink used for recording is relatively small. In addition, a waste-ink absorbing unit arranged for collecting the ink jetted in the flushing operation has to have a larger capacity.

In addition, if the minutely-vibrating operation is conducted in the recording apparatus, as the number of the operations (vibrations) of the pressure-generating member is large, the lifetime of the recording head is short.

SUMMARY OF THE INVENTION

The object of this invention is to solve the above problems, that is, to provide a liquid jetting apparatus such as an ink-jet recording apparatus that can more efficiently conduct a maintenance operation for preventing the viscosity of ink in a nozzle from increasing in order to keep good conditions condition for jetting a drop of the ink.

In order to achieve the object, a liquid jetting apparatus includes a head having a nozzle adapted to receive jetting data corresponding to one scanning movement in a main scanning direction. A head-scanning mechanism moves the head in the main scanning direction after the head has received the jetting data. A recovering unit recovers a suitable viscosity of liquid in the nozzle from an increased viscosity thereof. A measuring timer measures at least a part of the time since a previous operation of the recovering unit has been completed and a controller controls the recovering unit based on the time measured by the measuring timer.

According to the above features, since the recovering unit is controlled based on at least a part of the time since the previous operation of the recovering unit has been completed, a maintenance operation for recovering the suitable viscosity of the liquid in the nozzle can be conducted more efficiently, dependently on a state of the liquid in the nozzle.

For example, the part of the time since the previous operation of the recovering unit has been completed may be a time since the previous operation of the recovering unit has been completed until the head completes receiving the jetting data. In that case, preferably, a next operation of the recovering unit is conducted just after the head has completed receiving the jetting data.

Alternatively, when the head-scanning mechanism is adapted to move the head from a waiting position in the main scanning direction, after the head has received the jetting data, and to move back the head to the waiting position again, the part of the time since the previous operation of the recovering unit has been completed may be a time since the head has been moved back to the waiting position again after being moved in the main scanning direction until the head completes receiving the jetting data. In this manner, it is taken into consideration that in the time since the previous operation of the recovering unit has been completed, the receiving time of the jetting data may vary relatively widely depending on the jetting data.

Preferably, the controller may be adapted to control the recovering unit based on the jetting data itself.

In detail, when the head-scanning mechanism is adapted not to move the head to an area over a position to which a last drop of the liquid is jetted in the one scanning movement in the main scanning direction (when a scanning area (scanning columns) may be changed), the controller is preferably adapted to control the recovering unit depending on a distance for which the head is moved in a next scanning movement in the main scanning direction, based on the jetting data corresponding to the next scanning movement. Alternatively, in that case, the controller is preferably adapted to control the recovering unit depending on a distance for which the head has been moved in a previous scanning movement in the main scanning direction.

Alternatively, the controller is preferably adapted to control the recovering unit dependently depending on a distance for which the head is moved until a first drop of the liquid is jetted in a next scanning movement in the main scanning direction based on the jetting data corresponding to the next scanning movement.

Alternatively, when the head has a plurality of nozzles, and the recovering unit is adapted to recover a suitable viscosity of liquid in each of the plurality of nozzles from an increased viscosity thereof, the controller is preferably adapted to control the recovering unit depending on respective distances for which the head is moved until respective first drops of the liquid are jetted from the respective nozzles in a next scanning movement in the main scanning direction, based on the jetting data corresponding to the next scanning movement.

Alternatively, the controller is preferably adapted to control the recovering unit dependently depending on a proportion of the liquid jetted in a previous scanning movement in the main scanning direction.

Alternatively, when the head has a plurality of nozzles, and the recovering unit is adapted to recover a suitable viscosity of liquid in each of the plurality of nozzles from an increased viscosity thereof, the controller is preferably adapted to control the recovering unit depending on respective proportions of the liquid jetted from the respective nozzles in a previous scanning movement in the main scanning direction.

Alternatively, the controller is preferably adapted to control the recovering unit depending on a proportion of the liquid jetted in a next scanning movement in the main scanning direction based on the jetting data corresponding to the next scanning movement.

Alternatively, when the head has a plurality of nozzles, and the recovering unit is adapted to recover a suitable viscosity of liquid in each of the plurality of nozzles from an increased viscosity thereof, the controller is preferably adapted to control the recovering unit depending on respective proportions of the liquid jetted from the respective nozzles in a next scanning movement in the main scanning direction, based on the jetting data corresponding to the next scanning movement.

In addition, when the head has a plurality of nozzles in which a plurality of kinds of liquid are used, respectively, and the recovering unit is adapted to recover a suitable viscosity of liquid in each of the plurality of nozzles from an increased viscosity thereof, the controller is preferably adapted to control the recovering unit based on characteristics of the respective kinds of liquid used in the respective nozzles.

In addition, when the liquid jetting apparatus further includes a sensor for detecting a state of the environment where the liquid jetting apparatus is used, the controlling unit is preferably adapted to control the recovering unit based on an output from the sensor.

In addition, when the liquid jetting apparatus further includes a capping unit capable of being moved between a position away from the head and a position for coming in contact with the head in order to seal the nozzle, the controlling unit is preferably adapted to bring the capping unit in contact with the head based on the time measured by the measuring timer.

The recovering unit may be a minutely-vibrating unit for causing the liquid in the nozzle to minutely vibrate. Alternatively, the recovering unit may be a flushing unit for causing the liquid in the nozzle to jet out from the nozzle outside an objective jetting area.

In addition, a controlling unit for controlling a liquid jetting apparatus includes a head having a nozzle adapted to receive jetting data corresponding to one scanning movement in a main scanning direction. A head-scanning mechanism moves the head in the main scanning direction after the head has received the jetting data. A recovering unit recovers a suitable viscosity of liquid in the nozzle from an increased viscosity thereof. A measuring timer measures at least a part of the time since a previous operation of the recovering unit has been completed. The controlling unit is adapted to control the recovering unit based on the time measured by the measuring timer.

A computer system can constitute the whole controlling unit or only one or more components in the controlling unit.

This invention includes a storage unit capable of being read by a computer, storing a program for constituting the controlling unit in a computer system.

This invention also includes the program itself for constituting the controlling unit in the computer system.

This invention includes a storage unit capable of being read by a computer, storing a program including a command for controlling a second program executed by a computer system including a computer. The program is executed by the computer system to control the second program to constitute the controlling unit.

This invention also includes the program itself, including the command for controlling the second program executed by the computer system including the computer. The program is executed by the computer system to control the second program to constitute the controlling unit.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

First Embodiment (Basic Structure)

Figure 1:
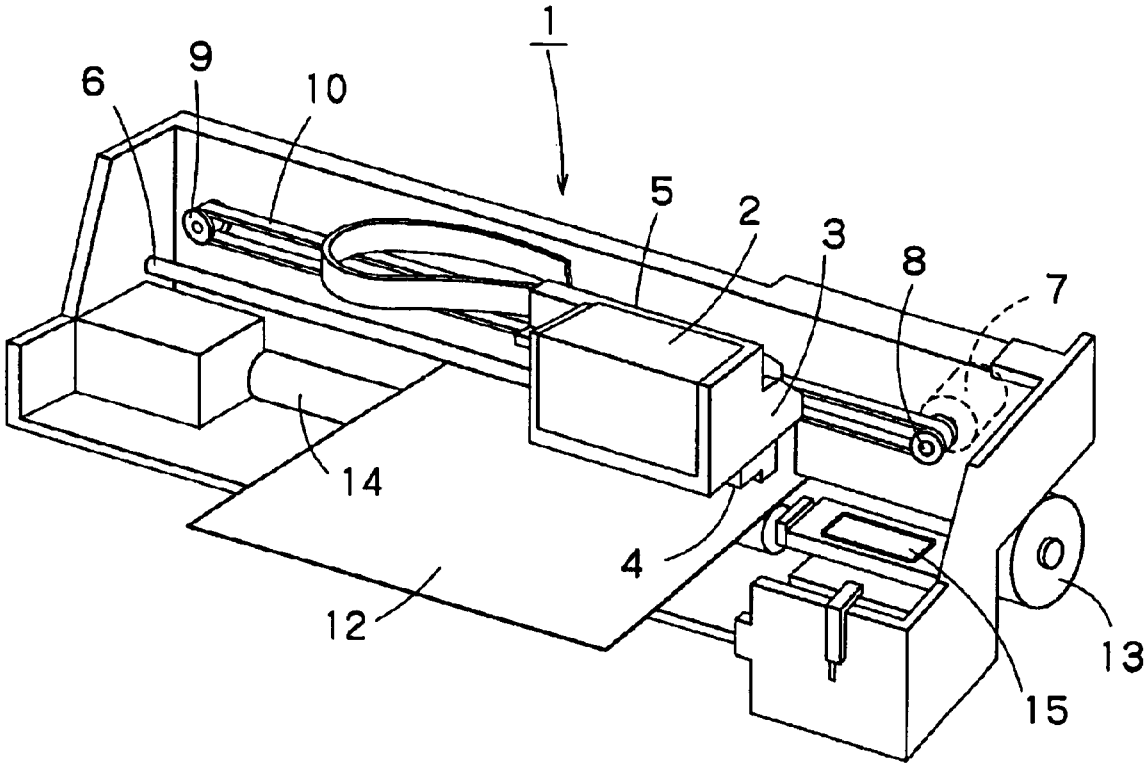
FIG. 1 is a schematic perspective view of an ink-jetting recording apparatus of a first embodiment according to the invention.

FIG. 1 is a schematic perspective view of an ink-jetting printer 1 as a liquid jetting apparatus of a first embodiment according to the invention. The ink-jetting printer 1 includes a carriage 5, which has a cartridge holder 3 capable of holding an ink cartridge 2 and a recording head 4. The carriage 5 is adapted to be reciprocated in a main scanning direction by a head-scanning mechanism.

The head-scanning mechanism is formed by: a guide bar 6 horizontally extending in a housing, a pulse motor 7 arranged at a right portion of the housing, a driving pulley 8 connected to a rotational shaft of the pulse motor 7, a free pulley 9 mounted at a left portion of the housing, a timing belt 10 connected to the carriage 5 and going around the driving pulley 8 and the free pulley 9, and a controller 11 (see FIG. 5) for controlling the pulse motor 7. Thus, the carriage 5, i.e. the recording head 4, can be reciprocated in the main scanning direction, i.e. in a width direction of a recording paper 12, by driving the pulse motor 7.

The printer 1 includes a paper feeding mechanism for feeding the recording paper 12 or any other recording medium in a feeding direction (subscanning direction). The paper feeding mechanism consists of a paper feeding motor 13 and a paper feeding roller 14 or the like. The recording paper 12, which is an example of a recording medium, is fed in a subordinate scanning direction in turn by the paper feeding mechanism in cooperation with the recording operation of the recording head 4.

The head scanning mechanism and the paper feeding mechanism in the embodiment are adapted to handle a recording paper 12 having a larger size such as a B-0 size. In addition, the printer 1 is adapted to conduct a recording operation when the recording head 4 is moved forth (single-direction recording).

Figure 2A:
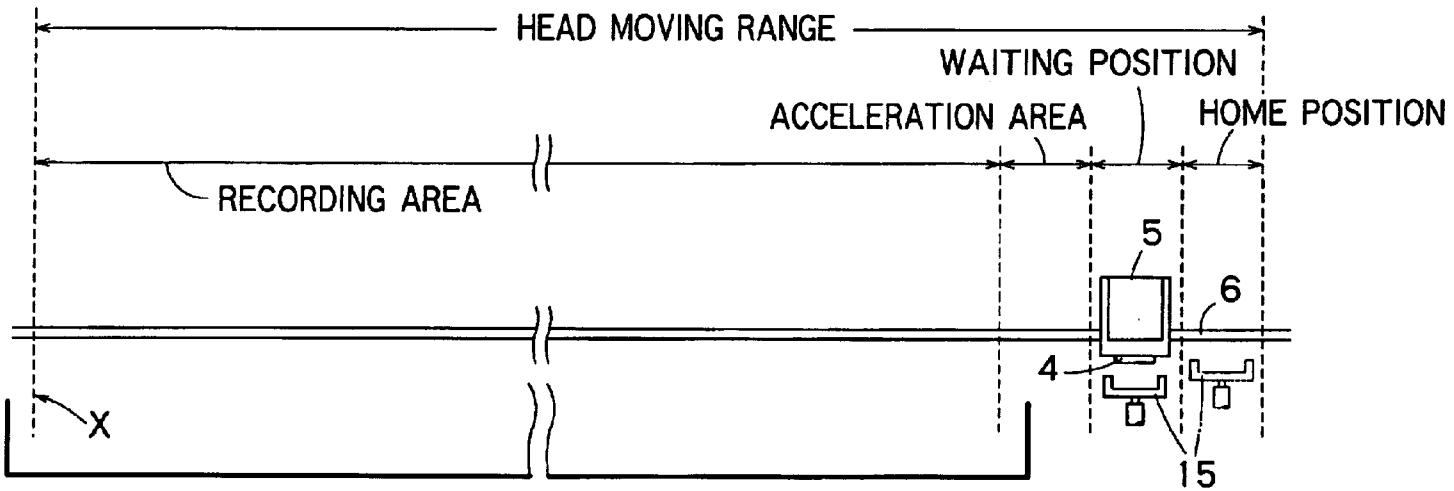
FIG. 2A is a schematic view for explaining a scanning range of a recording head when the ink-recording apparatus conducts a single-direction (one-way) printing.

A home position and a waiting position of the recording head 4 (carriage 5) are set in a scanning range of the carriage 5 and in an end area outside an objective recording area. As shown in FIG. 2A, the home position is set at an end portion (a right end portion in FIG. 2A) in the scanning range of the recording head 4. The waiting position is set substantially adjacently to the home position on a side of the objective recording area.

This invention can be applied to a printer that is adapted to conduct a recording operation when the recording head 4 is moved back as well when the recording head 4 is moved forth (double-direction recording), except it operates in a manner like a third embodiment of the invention described below. In such a printer, as shown in FIG. 2B, a second waiting position WP2 may be set at an opposite end portion with respect to a home position, in addition to a first waiting position WP1 substantially adjacent to the home position.

Figure 3A:
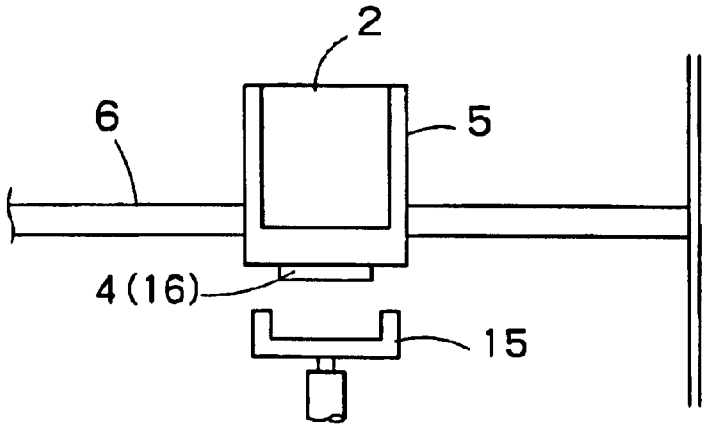
FIG. 3A is a schematic view for explaining a movement of the recording head, the recording head being located at a waiting position.
Figure 3B:
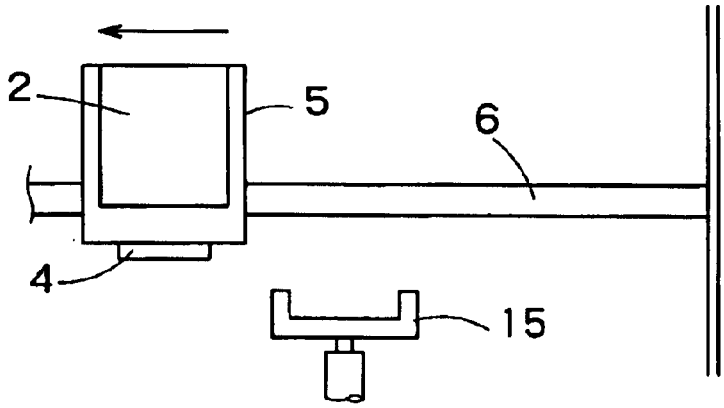
FIG. 3B is a schematic view for explaining the movement of the recording head, the recording head being moved from the waiting position to an objective recording area.

The home position is a position that the recording head 4 is moved to and stays at when electric power supply is off or when a long time has passed since the last recording operation. When the recording head 4 stays at the home position, as shown in FIG. 3D, a capping member 15 of the capping mechanism comes in contact with a nozzle plate 16 (see FIG. 4) and seals nozzles 17 (see FIG. 4). The capping member 15 is a tray-like member having a substantially square shape, being open upward, and made of an elastic material such as a rubber. A moisture retaining material such as felt is attached inside the capping member 15. When the recording head 4 is sealed by the capping member 15, the inside of the capping member 15 is kept in a highly humid condition. Thus, evaporation of the solvent of the ink from the nozzles 17 can be prevented.

The waiting position is a starting position for moving the recording head 4 in the main scanning direction. That is, normally, the recording head 4 stays and waits at the waiting position. When a recording operation is started, the recording head 4 is moved from the waiting position to the objective recording area. Then, when the recording operation is completed, the recording head 4 is moved back to the waiting position.

Figure 2B:
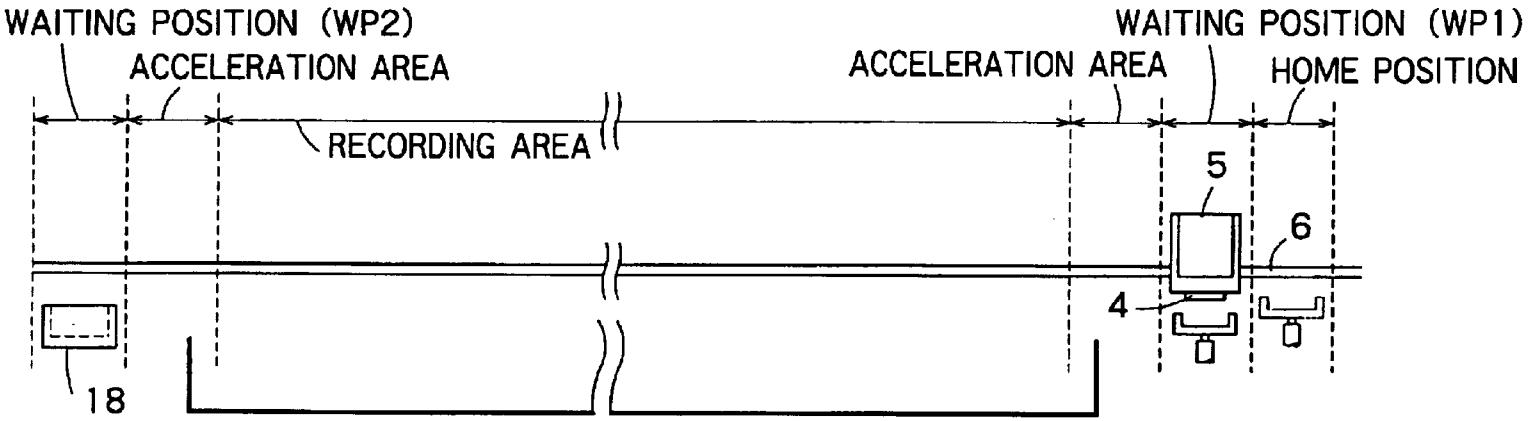
FIG. 2B is a schematic view for explaining a scanning range of a recording head when the ink-recording apparatus conducts a double-direction (forth and back) printing.

In a case of the printer for the double-direction recording, with reference to FIG. 2B, the recording head 4 is moved forth from the first waiting position WP1 to the second waiting position WP2 through the objective recording area, while jetting one or more drops of ink to the objective recording area. After that, the recording head 4 stays and waits at the second waiting position WP2. Then, the recording head 4 is moved back from the second waiting position WP2 to the first waiting position WP1 through the objective recording area while jetting one or more drops of ink to the objective recording area. After that, the recording head 4 stays and waits at the first waiting position WP1. After that, the recording operation moving forth and the recording operation during moved back are repeated in turn.

An ink-receiving member may be arranged under the waiting position for collecting ink discharged from the recording head 4 because of flushing operations (maintenance operations). In the embodiment, the capping member 15 functions as such an ink-receiving member. That is, the capping member 15 is usually located at a position under the waiting position of the recording head 4 (a little apart from the nozzle plate 16). Then, when the recording head 4 is moved to the home position, as shown in FIG. 3D, the capping member 15 is also moved diagonally upward to the home position and to the nozzle plate 16 in order to seal the nozzles 17.

In the case of the printer for the double-direction recording, as shown in FIG. 2B, a second ink-receiving member 18 may be arranged under the second waiting position WP2. The second ink-receiving member 18 may be a flushing box open upward, i.e. toward the recording head 4.

In addition, in the embodiment, an acceleration area is set between the waiting position and the objective recording area. The acceleration area is an area for raising a scanning velocity of the recording head 4 to a predetermined velocity.

Figure 4:
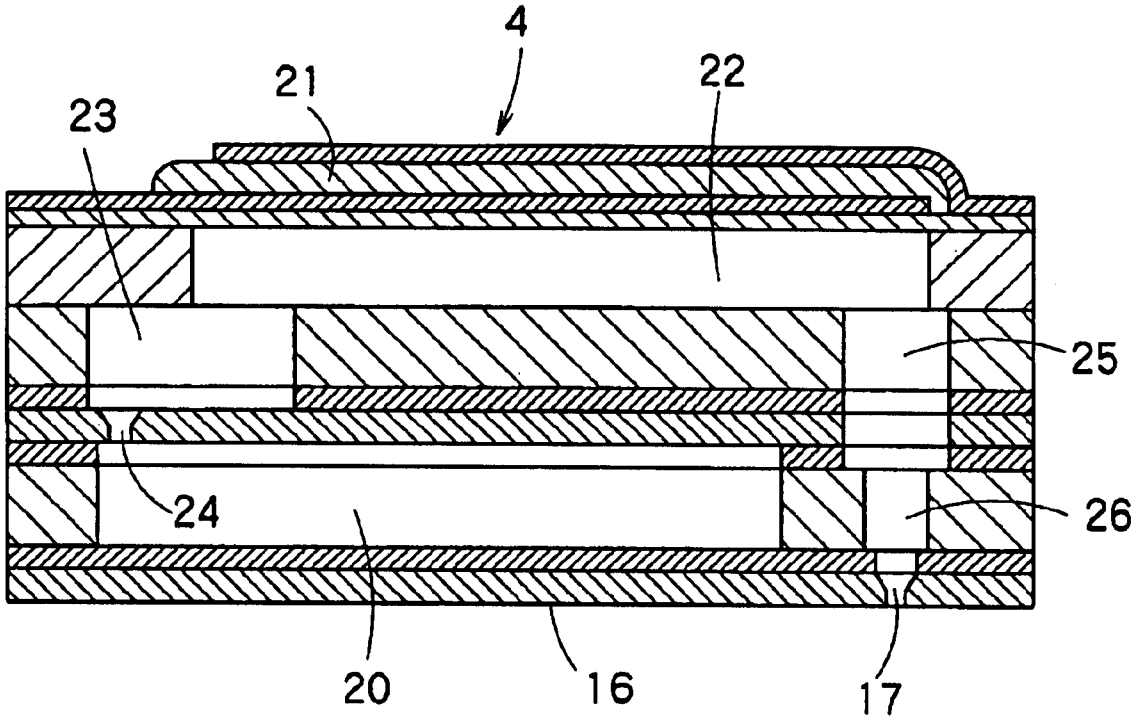
FIG. 4 is a sectional view of an example of a recording head.

The recording head 4 is now explained. As shown in FIG. 4, the recording head 4 mainly has an ink chamber 20 to which ink is supplied from the ink cartridge 2 (see FIG. 1) a nozzle plate 16 provided with a plurality of (for example 64) nozzles 17 in the sub-scanning direction and a plurality of pressure chambers 22 communicated with the plurality of nozzles 17, respectively. Each of the plurality of pressure chambers 22 is adapted to be caused to expand and contract by deformation of a piezoelectric vibrating member 21.

The ink chamber 20 and the plurality of pressure chambers 22 are communicated via a plurality of ink supplying holes 23 and a plurality of supply side communication holes 24, respectively. The plurality of pressure chambers 22 and the plurality of nozzles 17 are communicated via a plurality of first nozzle side communication holes 25 and a plurality of second nozzle side communication holes 26, respectively. Thus, for each of the plurality of nozzles 17, an ink passage is formed from the ink chamber 20 to each of the plurality of nozzles 17 via each of the plurality of pressure chambers 22.

In the embodiment, each of the piezoelectric vibrating members 21 is adapted to cause the pressure chambers 22 to expand or contract by distortion thereof. Thus, when the electric power (potential) is supplied to a piezoelectric vibrating member 21, the piezoelectric vibrating member 21 is charged and contracts in a direction perpendicular to a direction of the electric field. Then, a pressure chamber 22 corresponding to the piezoelectric vibrating member 21 is caused to contract. When the electric charges are discharged from the piezoelectric vibrating member 21, the piezoelectric vibrating member 21 extends in the direction perpendicular to the direction of the electric field. Then, a pressure chamber 22 corresponding to the piezoelectric vibrating member 21 is caused to expand.

That is, in the recording head 4, a volume of the pressure chamber 22 may be changed by the corresponding piezoelectric vibrating member 21 being charged or discharged. This may change pressure of the ink in the pressure chamber 22, so that a drop of the ink may be jetted from the corresponding nozzle 17 or a meniscus of the ink in the corresponding nozzle 17(a free surface of the ink exposed at an opening of the nozzle 17) may be caused to minutely vibrate.

For example, in order to jet a drop of the ink, a pressure chamber 22 is caused to once expand from an original volume thereof, and then to rapidly contract. Thus, a pressure of the ink in the pressure chamber 22 is rapidly raised, so that the drop of the ink may be jetted from the corresponding nozzle 17. In addition, in order to conduct a minutely-vibrating operation (a maintenance operation) wherein a meniscus is caused to minutely vibrate so that ink in a nozzle 17 is stirred to prevent viscosity of the ink from increasing, a pressure chamber 22 is caused to expand and/or contract in such a manner that the ink in the nozzle 17 may not be jetted.

Another type of piezoelectric vibrating member which may expand and contract in a longitudinal direction thereof can be also be used, instead of the piezoelectric vibrating member 21 causing the corresponding pressure chamber 22 to expand or contract by distortion thereof. In this case, the corresponding pressure chamber can expand by deformation of the piezoelectric vibrating member when the piezoelectric vibrating member is charged, and can contract by deformation of the piezoelectric vibrating member when the piezoelectric vibrating member is discharged.

Preferably, the recording head 4 may be a many-color-recording head capable of recording with a plurality of different colors. Such a many-color-recording head has a plurality of head units. Respective predetermined colors are set for and used in the plurality of head units, respectively.

For example, as an example of a many-color-recording head having four head units, a many-color-recording head may have: a black head unit capable of jetting a drop of black ink, a cyan head unit capable of jetting a drop of cyan ink, a magenta head unit capable of jetting a drop of magenta ink, and a yellow head unit capable of jetting a drop of yellow ink.

(Electric Structure)

Figure 5:
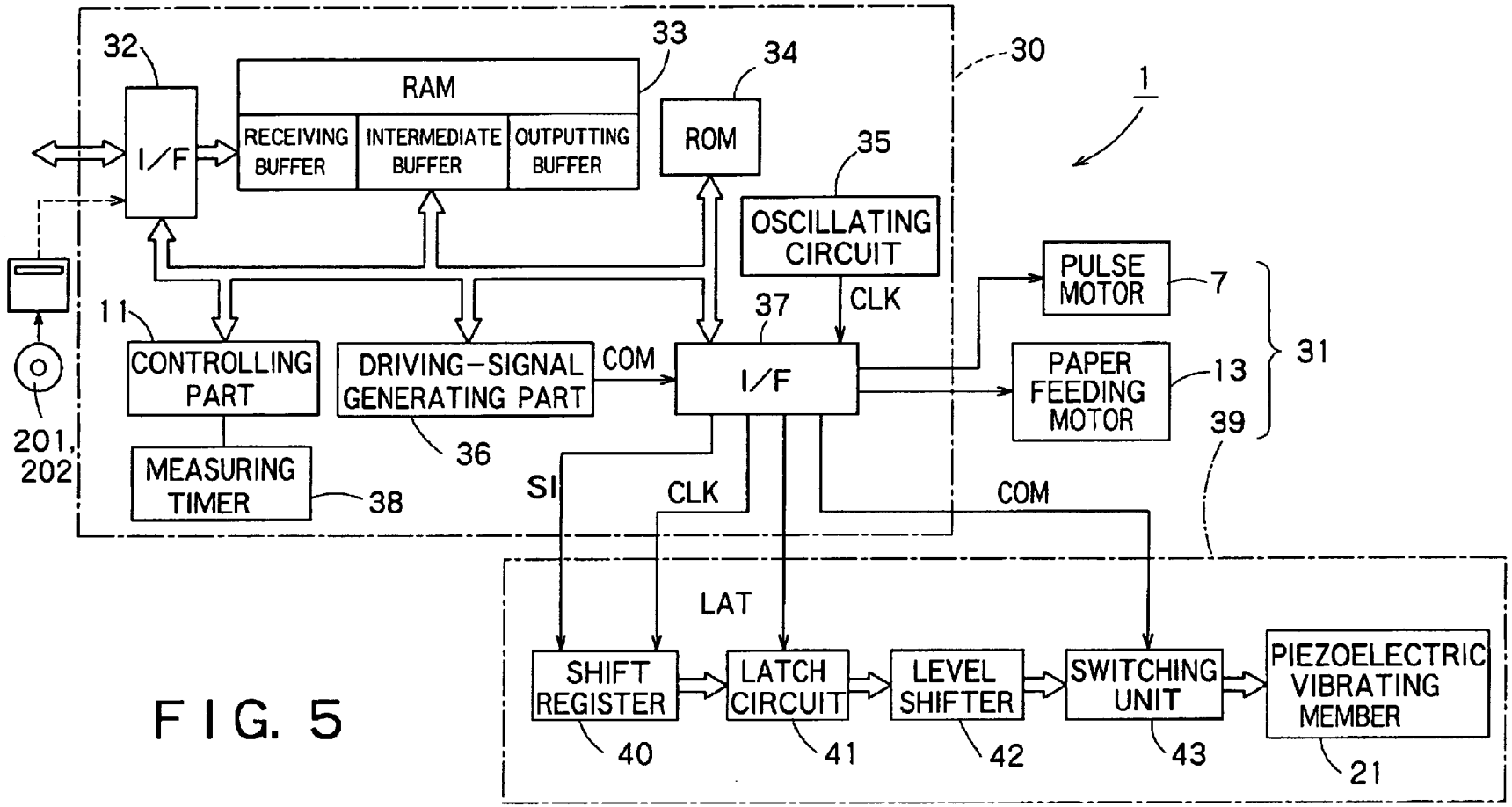
FIG. 5 is a schematic block diagram for explaining an electric structure of the recording head.

An electric structure of the printer 1 is now explained. As shown in FIG. 5, the ink-jetting printer 1 has a printer controller 30 and a printing engine 31.

The printer controller 30 has: an outside interface (outside I/F) 32, a RAM 33 which is able to temporarily store various data, a ROM 34 which stores a controlling program or the like, a controlling part 11 including a CPU or the like, an oscillating circuit 35 for generating a clock signal, an operating-signal generating part 36 for generating an operating signal that is supplied into a recording head 4, an inside interface (inside I/F) 37 that is adapted to send the operating signal, dot-pattern-data (bit-map-data) developed according to printing data (jetting data) or the like to the print engine 31, and a measuring timer 38.

The outside I/F 32 is adapted to receive printing data consisting of character codes, graphic functions, image data or the like from a host computer (not shown) or the like. In addition, a busy signal (BUSY) or an acknowledge signal (ACK) is adapted to be outputted to the host computer or the like through the outside I/F 32.

The RAM 33 has a receiving buffer, an intermediate buffer, an outputting buffer and a work memory (not shown). The receiving buffer is adapted to receive the printing data through the outside I/F 32, and temporarily store the printing data. The intermediate buffer is adapted to store intermediate-code-data converted from the printing data by the controlling part 11. The outputting buffer is adapted to store dot-pattern-data which are data for printing obtained by decoding (translating) the intermediate-code-data (for example, level data).

The ROM 34 stores font data, graphic functions or the like in addition to the controlling program (controlling routine) for carrying out various data-processing operations. The ROM 34 also stores various setting data for maintenance operations as a holding means for holding maintenance information.

The controlling part 11 is adapted to carry out various controlling operations according to the controlling program stored in the ROM 34. For example, the controlling part 11 reads out the printing data from the receiving buffer, converts the printing data into the intermediate-code-data, and causes the intermediate buffer to store the intermediate-code-data. Then, the controlling part 11 analyzes the intermediate-code-data in the intermediate buffer and develops (decodes) the intermediate-code-data into the dot-pattern-data with reference to the font data and the graphic functions or the like stored in the ROM 34. Then, the controlling part 11 carries out necessary decorating operations to the dot-pattern-data, and thereafter causes the outputting buffer to store the dot-pattern-data.

When the dot-pattern-data corresponding to one line recorded by one main scanning of the recording head 4 are obtained, the dot-pattern-data are outputted to an electric driving system 39 of the recording head 4 from the outputting buffer through the inside I/F 37 in turn. Then, the carriage 5 is moved in the main scanning direction, that is, the recording operation for the one line is conducted. When the dot-pattern-data corresponding to the one line are outputted from the outputting buffer, the intermediate-code-data that has been developed are deleted from the intermediate buffer, and the next developing operation starts for the next intermediate-code-data.

In addition, the controlling part 11 controls a maintenance operation (a recovering operation) conducted before the recording operation by the recording head 4.

The measuring timer 38 is adapted to measure a time (a one-path time) from a point of time when a previous maintenance operation has been completed until a point of time when the recording head has completed receiving the printing data for the next recording operation through the recording operation for the ne line(one path).

The print engine 31 includes the paper feeding motor 13 as a paper feeding mechanism, the pulse motor 7 as a head scanning mechanism, and an electric driving system 39 of the recording head 4.

The electric driving system 39 of the recording head 4 is now explained. As shown in FIG. 5, the electric driving system 39 includes shift registers 40, latch circuits 41, level shifters 42, switching units 43 and the piezoelectric vibrating members 21, which are electrically connected in order. The shift registers 40 correspond to the respective nozzles 17 of the recording head 4. Similarly, the latch circuits 41 correspond to the respective nozzles 17, the level shifters 42 correspond to the respective nozzles 17, and the switching units 43 correspond the respective nozzles 17. In addition, the piezoelectric vibrating members 21 correspond to the respective nozzles 17 of the recording head 4.

In the electric driving system 39, when a bit "1" of printing data is supplied to a switching unit 43, the switching unit 43 is closed (connected) and the operating signal (COM) is directly supplied to a corresponding piezoelectric vibrating member 21. Thus, the piezoelectric vibrating member 21 deforms according to a waveform of the operating signal. On the other hand, when a bit "0" of printing data is supplied to a switching unit 43, the switching unit 43 is opened (unconnected) and the operating signal (COM) is not supplied to a corresponding piezoelectric vibrating member 21.

As described above, based on the printing data, the operating signal may be selectively supplied to each piezoelectric vibrating member 21. Thus, depending on the given printing data, a drop of the ink may be jetted from a nozzle 17 or a meniscus of ink may be caused to minutely vibrate.

(Operation of the Printer)

An operation of the printer 1 is now explained with reference to FIGS. 2A to 3D.

When electric power is supplied to the printer 1, a necessary initializing operation is conducted at first. Then, the recording head 4 waits (stands by) at the waiting position (as shown in FIG. 3A). After printing data corresponding to one line is outputted from the outputting buffer of the RAM 33, the recording head 4 conducts a maintenance operation (recovering operation) before a recording operation for the one line.

The maintenance operation is conducted for keeping the ability of the recording head 4 to jet drops of the ink. The maintenance operation may be suitably selected from a flushing operation, a minutely-vibrating operation, and so on.

In detail, the flushing operation is an operation for forcibly causing ink to jet out from the recording head 4 toward the ink-receiving member (capping member 15) outside the objective recording area. The flushing operation is conducted while the recording head 4 waits at the waiting position. Owing to the flushing operation, ink having an increased viscosity in and/or near to the nozzle 17 may be discharged out from the recording head 4 and replaced with ink having a suitable viscosity.

As described above, the minutely-vibrating operation is an operation for causing a meniscus of ink to minutely vibrate by causing the pressure chamber 22 to expand and/or contract in such a manner that the ink may not be jetted. In the embodiment, the minutely-vibrating operation is conducted while the recording head 4 waits at the waiting position and while the recording head 4 is moved in the acceleration area.

An initial value of an execution amount of the maintenance operation for a first scanning (recording) movement (first path) in the main scanning direction is set in such a manner that the ability to jet drops of the ink may be satisfactorily maintained even at an end position X in the objective recording area furthest away from the waiting position (see FIG. 2A), that is, in such a manner that the quality of a printed image may be ensured even at the end portion X.

For example, when a flushing operation is conducted as a maintenance operation, an initial value of a number of jetting a drop of the ink during the flushing operation (flushing-shot number) may be set at "200". Similarly, when a minutely-vibrating operation is conducted as a maintenance operation, an initial value of a number of operations of the piezoelectric vibrating member 21 during the minutely-vibrating operation (number of times of minutely-vibrating) may be at "200".

If the flushing operation is conducted, the recording head 4 starts to be moved just after the flushing operation is completed. If the minutely-vibrating operation is conducted, the recording head 4 starts to be moved at a suitable timing after the completion of receiving the printing data.

That is, after the maintenance operation is conducted, the recording operation is conducted in the objective recording area based on the printing data.

Figure 3C:
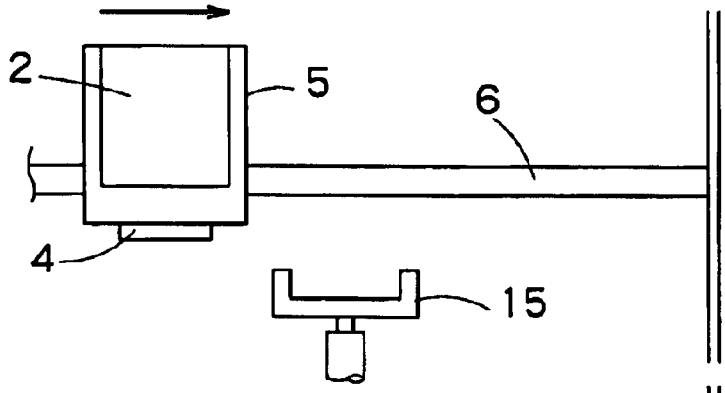
FIG. 3C is a schematic view for explaining the movement of the recording head, the recording head being moved back from the objective recording area to the waiting position.
Figure 3D:
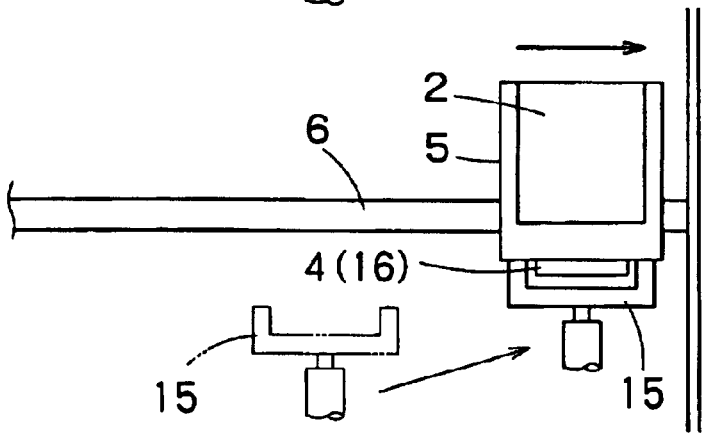
FIG. 3D is a schematic view for explaining the movement of the recording head, the recording head being located at a home position.

After the recording operation in the first scanning movement (first path) has been completed (see FIGS. 3A and 3B), the recording head 4 is moved back to and waits at the waiting position (see FIGS. 3C and 3D). Then, the recording head 4 stays and waits at the waiting position until the recording head 4 completes receiving printing data corresponding to a next line. After the recording head 4 has received the printing data corresponding to the next line transferred from the printer controller 30, a maintenance operation for a second scanning movement (second path) is conducted.

An execution amount of the maintenance operation for the second scanning movement is set based on a one-path time of the recording head 4 measured by the measuring timer 38.

That is, the controlling part 11 sets a flushing-shot number for a flushing operation or a number of times of minutely-vibrating for a minutely-vibrating operation based on the one-path time measured by the measuring timer 38. The one-path time means a time from a point of time when the maintenance operation for the first scanning movement has been completed until a point of time when the recording head has completed receiving the printing data for the second recording operation (second path), through the first recording operation (first path) and a return of the recording head 4 to the waiting position.

In detail, the controlling part 11 sets the flushing-shot number or the number of times of minutely-vibrating based on maintenance setting data stored in the ROM 34. For example, the maintenance setting data may be given as table information as shown by a graph in FIG. 6.

Figure 6:
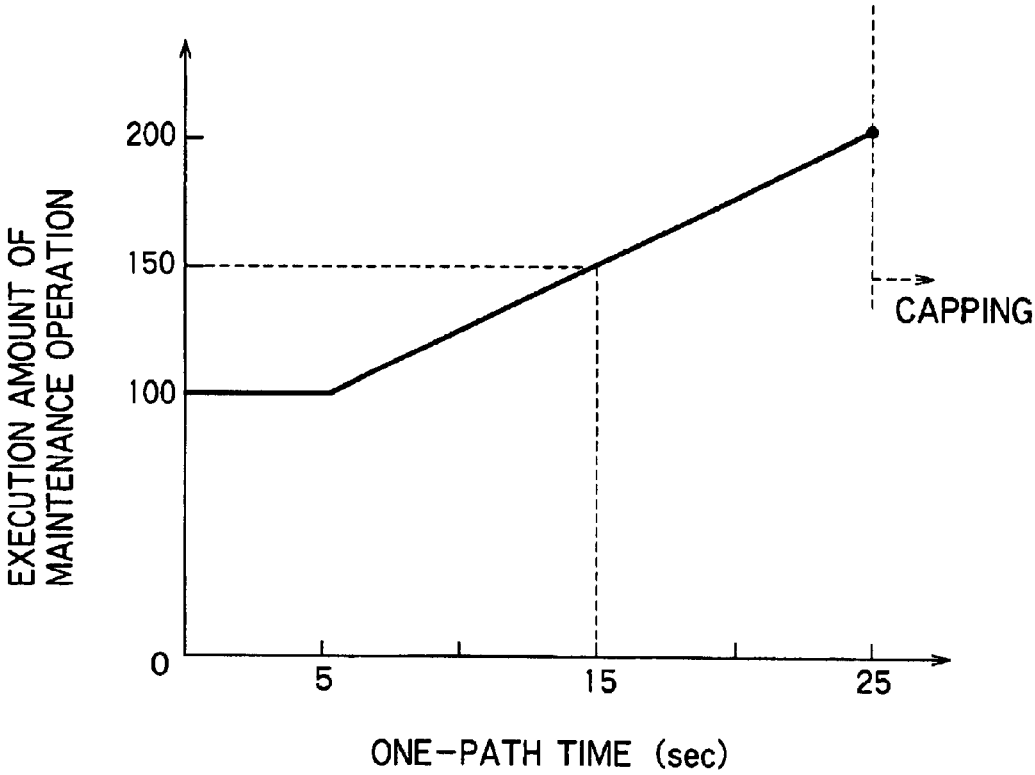
FIG. 6 is a graph for explaining an example of a relationship between one-path times and execution amounts of a maintenance operation.

According to the maintenance setting data shown by the graph in FIG. 6, an execution amount of the maintenance operation (the flushing-shot number or the number of times of minutely-vibrating) is "100" if the one-path time is 0 to 5 seconds. In addition, an execution amount of the maintenance operation is "200" if the one-path time is 25 seconds. In this case, the one-path time is 5 seconds if the recording head 4 starts to be moved again for a next recording operation just after or just when the recording head 4 has been moved back to the waiting position after a previous recording operation. That is, the one-path time may be changed mainly depending on an amount of the printing data received by the recording head 4. Of course, when the recording head 4 is not moved in the whole scanning range based on the printing data, for example, when the recording head 4 is mot moved over a position to which a last drop of the ink is jetted in the scanning movement, the one-path time may also be changed thereby.

When the one-path time is in a range of 5 to 25 seconds, the execution amount of the maintenance operation is proportional to the one-path time. That is, the execution amount of the maintenance operation is more when the one-path time is longer in the range.

Thus, the controlling part 11 sets the execution amount of the maintenance operation based on the one-path time, and causes a maintenance operation to be conducted based on the set execution amount.

For example, when the flushing operation is conducted for the printer 1 and the one-path time is 15 seconds, a number of "150" is set as the flushing-shot number. Then, a drop of the ink is jetted 150 times during the flushing operation. Alternatively, when the one-path time is 5 seconds, that is, when the recording head 4 starts to be moved again for the second recording operation just after or just when the recording head 4 has been moved back to the waiting position after the first recording operation, a number of "100" is set as the flushing-shot number. Then, a drop of the ink is jetted 100 times during the flushing operation. Thus, in the flushing operation, the volume of the jetted ink may increase or decrease depending on the one-path time of the recording head 4.

Similarly, when the minutely-vibrating operation is conducted for the printer 1 and the one-path time is 15 seconds, a number of "150" is set as the number of times of minutely-vibrating. Alternatively, when the one-path time is 5 seconds, a number of "100" is set as the number of times of minutely-vibrating. Thus, in the minutely-vibrating operation, the number of times of minutely-vibrating may increase or decrease depending on the one-path time of the recording head 4.

As described above, if the execution amount of the maintenance operation is set depending on the one-path time of the recording head 4, the maintenance operation is conducted more efficiently while the quality of the printed image is ensured even at the end position in the objective recording area while too much maintenance operation is avoided.

In detail, when the one-path time of the recording head 4 is relatively short, a time for which a meniscus of the ink is exposed to air is also relatively short. In addition, it is possible that the meniscus remains vibrating because of the previous recording operation. That is, it may tend to be prevented that a viscosity of the ink in or near to the nozzle 17 increases. Thus, if the execution amount of the maintenance operation is set relatively small, the quality of the printed image can be ensured even at the end position in the objective recording area.

On the other hand, when the one-path time of the recording head 4 is relatively long, a time for which a meniscus of the ink is exposed to air is also relatively long. Then, the solvent of the ink tends to evaporate more. Thus, the viscosity of the ink in or near to the nozzle 17 may tend to rise to a degree affecting the quality of the printed image. Thus, the execution amount of the maintenance operation is set relatively large, in order to ensure the quality of the printed image even at the end position in the objective recording area.

In addition, when the one-path time of the recording head 4 is longer than a predetermined capping time (for example 25 seconds), that is, when the recording head 4 still has not completed receiving the printing data when the capping time has passed, the controlling part 11 outputs instructions for a capping operation. Based on the instructions for the capping operation, the recording head 4 is moved from the waiting position to the home position. Then, the capping member 15 is moved to come in contact with the nozzle plate 16, and seals the nozzles 17 (see FIG. 3D). In such a capping state, the moisture retaining material, in which ink is contained, heightens the humidity inside the capping member 15. Thus, it can be prevented that the solvent of the ink evaporates from the nozzles 17. Thus, it can be prevented that the density of the ink in the recording head 4 increases too much.

For example, the capping state may be released when the recording head 4 has completed receiving the printing data (dot-pattern-data). When the capping state is released, the recording head 4 is moved back to the waiting position. The initial value of the execution amount of the maintenance operation for the first scanning movement may be used as the execution amount of the maintenance operation after the capping state.

In the embodiment, the third (third path) and further recording operations are conducted similarly to the second recording operation.

As described above, according to the first embodiment, when the flushing operation is conducted for the printer 1 as the maintenance operation, the volume of the ink jetted during the flushing operation can be reduced to only a necessary volume depending on the one-path time of the recording head 4. Thus, the volume of the ink used for the recording operations can be relatively increased. That is, more recording operations can be conducted with the limited volume of the ink stored in the ink-cartridge 2.

In addition, a waste-liquid collecting unit for collecting the ink jetted during the flushing operation can have only a smaller capacity.

In addition, when the minutely-vibrating operation is conducted for the printer 1 as the maintenance operation, the number of times the piezoelectric vibrating member 21 is actuated during the minutely-vibrating operation can be reduced to only a necessary number of times. Thus, the lifetime of the recording head 4 can be extended.

The above description is given for the case that a flushing operation is conducted while the recording head 4 stays at the waiting position. However, if another ink-receiving member is arranged corresponding to the acceleration area, the flushing operation can be conducted while the recording head 4 is moved in the acceleration area.

Second Embodiment

A second embodiment of the invention is now explained. In the second embodiment, the measuring timer 38 is adapted to measure a carriage-waiting time. The carriage-waiting time means a time from a point of time when the recording head 4 has been moved back to the waiting position after completing one recording operation until a point of time when the recording head 4 completes receiving the printing data for a next recording operation.

In the embodiment, the controlling part 11 sets a flushing-shot number for a flushing operation or a number of times of minutely-vibrating for a minutely-vibrating operation, based on the carriage-waiting time measured by the measuring timer 38.

In detail, the controlling part 11 sets the flushing-shot number or the number of times of minutely-vibrating based on maintenance setting data stored in the ROM 34. For example, the maintenance setting data may be given as table information as shown by a graph in FIG. 7.

Figure 7:
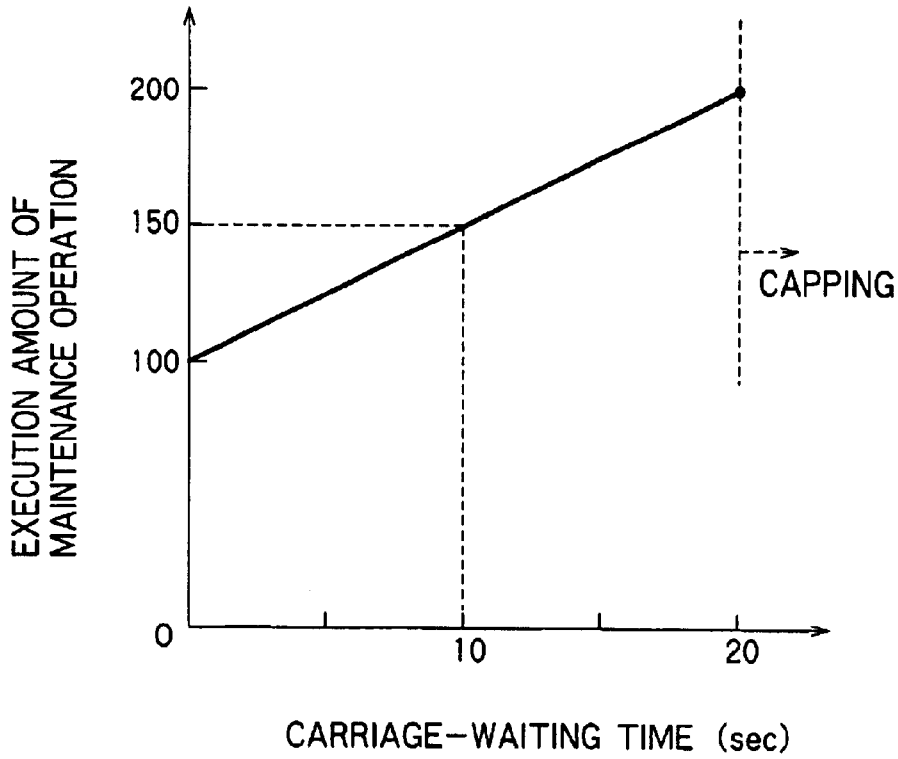
FIG. 7 is a graph for explaining an example of a relationship between waiting times and execution amounts of a maintenance operation.

According to the maintenance setting data shown by the graph in FIG. 7, an execution amount of the maintenance operation (the flushing-shot number or the number of times of minutely-vibrating) is "100", if the carriage-waiting time is 0 second. In addition, an execution amount of the maintenance operation is "200", if the carriage-waiting time is 20 seconds.

When the carriage-waiting time is in a range of 0 to 20 seconds, the execution amount of the maintenance operation is proportional to the carriage-waiting time. That is, the execution amount of the maintenance operation is more when the carriage-waiting time is longer in the range.

The other structure is substantially the same as the first embodiment shown in FIGS. 1 to 6. In the second embodiment, the same reference numerals correspond to the same elements as the first embodiment. The explanation of the same elements is not repeated.

The controlling part 11 of the second embodiment sets the execution amount of the maintenance operation based on the carriage-waiting time, and causes a maintenance operation to be conducted based on the set execution amount.

For example, when the flushing operation is conducted for the printer 1 and the carriage-waiting time is 10 seconds, a number of "150" is set as the flushing-shot number. Then, a drop of the ink is jetted 150 times during the flushing operation. Alternatively, when the carriage-waiting time is 0 seconds, that is, when the recording head 4 starts to be moved again for the second recording operation just after or just when the recording head 4 has been moved back to the waiting position after the first recording operation, a number of "100" is set as the flushing-shot number. Then, a drop of the ink is jetted 100 times during the flushing operation. Thus, in the flushing operation, volume of the jetted ink may increase or decrease dependently on the carriage-waiting time of the recording head 4.

Similarly, when the minutely-vibrating operation is conducted for the printer 1 and the carriage-waiting time is 10 seconds, a number of "150" is set as the number of times of minutely-vibrating. Alternatively, when the carriage-waiting time is 0 seconds, a number of "100" is set as the number of times of minutely-vibrating. Thus, in the minutely-vibrating operation, the number of times of minutely-vibrating may increase or decrease depending on the carriage-waiting time of the recording head 4.

As described above, if the execution amount of the maintenance operation is set depending on the carriage-waiting time of the recording head 4, the maintenance operation is conducted more efficiently while the quality of the printed image is ensured even at the end position in the objective recording area and while too much maintenance operation is avoided.

In addition, when the carriage-waiting time of the recording head 4 is longer than a predetermined capping time (for example 20 seconds), that is, when the recording head 4 still has not completed receiving the printing data when the capping time has passed, the controlling part 11 outputs instructions for a capping operation. Based on the instructions for the capping operation, the recording head 4 is moved from the waiting position to the home position. Then, the capping member 15 is moved to come in contact with the nozzle plate 16, and seals the nozzles 17 (see FIG. 3D). In such a capping state, the moistening material, in which ink is contained, heightens the humidity inside the capping member 15. Thus, it can be prevented that the solvent of the ink evaporates from the nozzles 17. Thus, it can be prevented that density of the ink in the recording head 4 increases too much.

Third Embodiment

Figure 8:
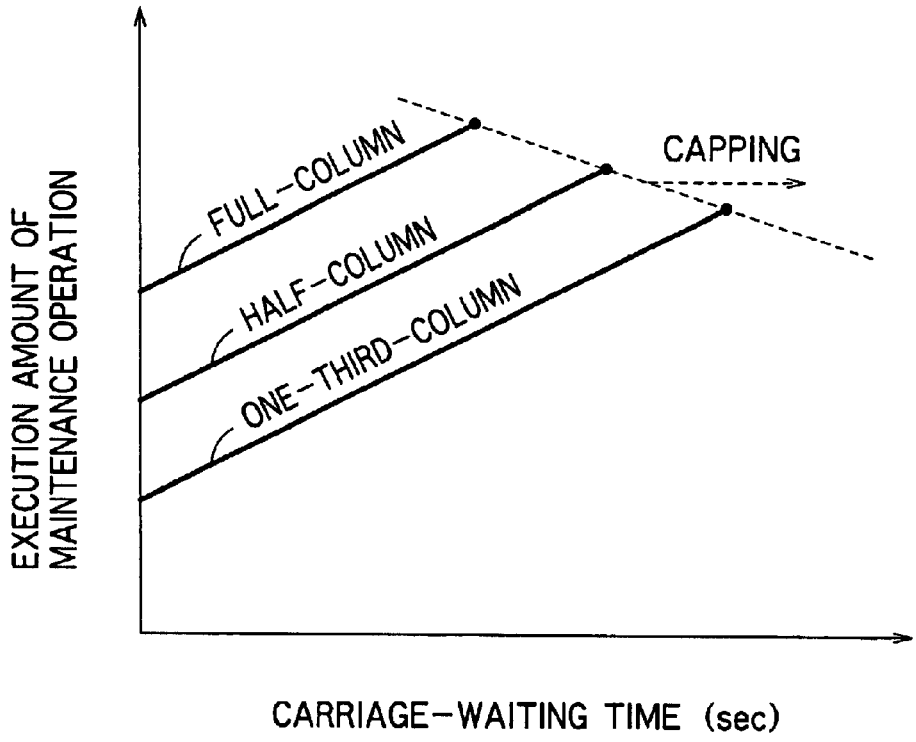
FIG. 8 is a graph for explaining an example of a relationship between waiting times and execution amounts of a maintenance operation when scanning distances of the recording head are taken into consideration.

A third embodiment of the invention is now explained. FIG. 8 is a graph for explaining a relationship between carriage-waiting times and execution amounts of maintenance operation (flushing-shot numbers or numbers of times of minutely-vibrating) and a relationship between carriage-waiting times and capping times, in the third embodiment. The controlling part 11 of the third embodiment sets the execution amount of the maintenance operation by taking into account the printing columns (the printing area) in the current recording operation, that is, by taking into account the scanning distance of the recording head 4 in the main scanning direction.

In detail, in the third embodiment, based on printing data for each line (each path), one of full-column setting data, half-column setting data and one-third-column setting data are respectively used. These three setting data are table data, respectively. The three setting data are stored in the ROM 34 as maintenance setting data, respectively.

The full-column setting data are adapted to be used when a scanning-end position of the scanning movement of the recording head 4 during the recording operation after the maintenance operation is located in a range between a substantially center position (half-column) of the objective recording area in the main scanning direction and the end position X (last-column) in the objective recording area furthest away from the waiting position.

The half-column setting data are adapted to be used when a scanning-end position of the scanning movement of the recording head 4 during the recording operation is located in a range between a substantially one-third position (one-third-column) of the objective recording area in the main scanning direction and the substantially center position (half-column) of the objective recording area in the main scanning direction.

The one-third-column setting data are adapted to be used when a scanning-end position of the scanning movement of the recording head 4 during the recording operation is located in a range to the substantially one-third position (one-third-column) of the objective recording area in the main scanning direction.

For example, the scanning-end position of the scanning movement of the recording head 4 can be obtained from the printing data developed in the RAM 33.

According to the respective setting data, the execution amount of the maintenance operation is proportional to the carriage-waiting time. That is, the execution amount of the maintenance operation is more when the carriage-waiting time is longer.

In addition, comparing the full-column setting data, the half-column setting data and the one-third-column setting data with each other, with respect to the same carriage-waiting time, the execution amount of the maintenance operation according to the full-column setting data is set most, the execution amount of the maintenance operation according to the half-column setting data is set less than that according to the full-column setting data, and the execution amount of the maintenance operation according to the one-third-column setting data is set less than that according to the half-column setting data.

The other structure is substantially the same as the second embodiment shown in FIG. 7. In the third embodiment, the same numeral references correspond to the same elements as the second embodiment. The explanation of the same elements is not repeated.

The controlling part 11 of the third embodiment is adapted to set the execution amount of the maintenance operation, based on the above setting data, in such a manner that if a scanning distance of the current scanning movement of the recording head 4 is shorter, the execution amount of the maintenance operation is less.

If the scanning distance of the current scanning movement of the recording head 4 is shorter, that is, if the scanning area (columns) is smaller, a no-jetting (free-running) distance of the recording head 4 is shorter even when a first drop of the ink is jetted at a position in the scanning area furthest away from the waiting position. Thus, the solvent of the ink may evaporate less. Thus, the viscosity of the ink in or near to the nozzle 17 may not tend to rise to a degree affecting the quality of the printed image. Thus, the quality of the printed image at the end position in the scanning area can be ensured, even if the execution amount of the maintenance operation is set relatively small.

On the other hand, if a scanning distance of the current scanning movement of the recording head 4 is longer, that is, if the scanning area (columns) is larger, no-jetting (free-running) distance of the recording head 4 may be longer when a first drop of the ink is jetted at a position in the scanning area furthest away from the waiting position. Then, the solvent of the ink tends to evaporate more. Thus, the viscosity of the ink in or near to the nozzle 17 may tend to rise to a degree affecting the quality of the printed image. Thus, the execution amount of the maintenance operation is set relatively large in order to ensure the quality of the printed image even at the end position in the scanning area.

With respect to the capping time, the capping time according to the full-column setting data is set shortest, the capping time according to the half-column setting data is set second shortest, and the capping time according to the one-third-column setting data is set longest.

That is, if a scanning distance of the current scanning movement of the recording head 4 is longer, the no-jetting (free-running) distance of the recording head 4 may be longer when a first drop of the ink is jetted at a position in the scanning area furthest away from the waiting position. Then, the first drop of the ink is liable to be jetted in a state wherein the viscosity of the ink has risen too much. Thus, the capping time is set relatively short, in order to ensure the quality of the printed image even at the end position in the scanning area.

On the other hand, if a scanning distance of the current scanning movement of the recording head 4 is shorter, the no-jetting (free-running) distance of the recording head 4 is shorter even when a first drop of the ink is jetted at a position in the scanning area furthest away from the waiting position. Thus, the first drop of the ink may hardly be jetted in a state wherein the viscosity of the ink has risen too much. Thus, the quality of the printed image at the end position in the scanning area can be ensured, even if the capping time is set relatively long.

In addition, in the third embodiment, the execution amount of the maintenance operation can be set by taking into account the scanning distance of the recording head 4 in the previous recording operation, instead of the scanning distance of the recording head 4 in the current recording operation.

That is, if the scanning distance of the previous scanning movement of the recording head 4 is shorter, the no-jetting (free-running) distance and the no-jetting (free-running) time of the recording head 4 from the scanning-end position to the waiting position are shorter, respectively. Thus, the solvent of the ink may evaporate less. Thus, the viscosity of the ink in or near to the nozzle 17 may not tend to rise to a degree affecting the quality of the printed image. Thus, the quality of the printed image in the next scanning area (including its end position) can be ensured, even if the execution amount of the maintenance operation is set smaller.

On the other hand, if a scanning distance of the previous scanning movement of the recording head 4 is longer, the above no-jetting (free-running) distance and the above no-jetting (free-running) time may be longer. Then, the solvent of the ink tends to evaporate more. Thus, the viscosity of the ink in or near to the nozzle 17 may tend to rise to a degree affecting the quality of the printed image. Thus, the execution amount of the maintenance operation is set larger, in order to ensure the quality of the printed image in the next scanning area (including its end position).

Similarly, the respective capping times can be set by taking into account the scanning distance of the recording head 4 in the previous recording operation.

That is, if a scanning distance of the previous scanning movement of the recording head 4 is long, as described above, the viscosity of the ink in or near to the nozzle 17 tends to rise too much. Thus, the capping time is set relatively short, in order to prevent the viscosity of the ink in or near to the nozzle 17 from rising too much.

On the other hand, if a scanning distance of the previous scanning movement of the recording head 4 is short, as described above, the viscosity of the ink in or near to the nozzle 17 hardly tends to rise too much. Thus, the quality of the printed image at the end position in the next scanning area can be ensured, even if the capping time is set relatively long.

In addition, it is also effective to set the execution amount of the maintenance operation by taking into account both of the scanning distance of the recording head 4 in the previous recording operation and the scanning distance of the recording head 4 in the current recording operation. For example, an average of the scanning distance in the previous recording operation and the scanning distance in the current recording operation can be used. Alternatively, the longer one of the scanning distance in the previous recording operation and the scanning distance in the current recording operation can be used.

As described above, in the third embodiment, since the execution amount of the maintenance operation is set by taking into account the scanning distance of the recording head 4 in the recording operation, a degree of evaporation of the solvent of the ink, which may be caused by a no-jetting scanning of the recording head 4, can be considered. Thus, the maintenance operation may be conducted more suitably.

As a result, when the flushing operation is conducted, the volume of the waste ink can be reduced more. When the minutely-vibrating operation is conducted, the lifetime of the piezoelectric vibrating member 21 can be extended.

In addition, the division of the respective setting data is not limited to the above embodiment, but could be freely set.

Fourth Embodiment

Figure 9:
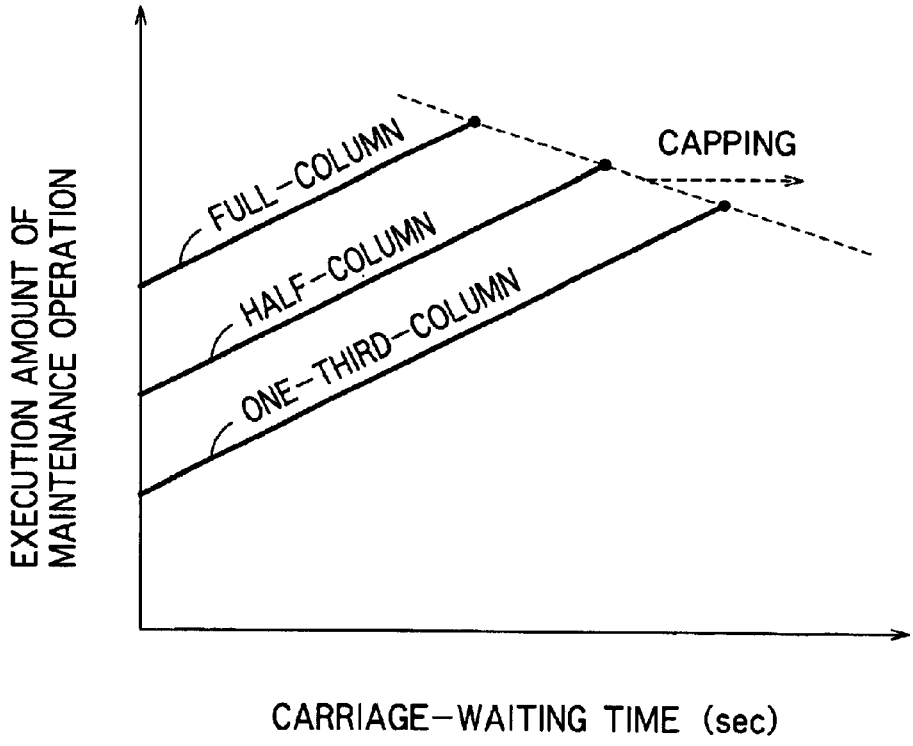
FIG. 9 is a graph for explaining an example of a relationship between waiting times and execution amounts of a maintenance operation when positions where first drops of ink are jetted in a current recording operation (scanning movement) are taken into consideration.

A fourth embodiment of the invention is now explained. FIG. 9 is a graph for explaining a relationship between carriage-waiting times and execution amounts of the maintenance operation (flushing-shot numbers or numbers of times of minutely-vibrating) and a relationship between carriage-waiting times and capping times in the fourth embodiment. The controlling part 11 of the fourth embodiment sets the execution amount of the maintenance operation by taking into account a scanning distance until a first drop of the ink is jetted in the recording operation.

In this case, the controlling part 11 can obtain the scanning 30 distance of the recording head 4 until the first drop of the ink is jetted from the nozzle 17 in the current recording operation through the printing data or the number of pulses supplied to the pulse motor 7. Then, the execution amount of the maintenance operation (a number of times of jetting a drop of the ink during the flushing operation or a number of times of actuating the piezoelectric vibrating member 21 during the minutely-vibrating operation) is set corresponding to the carriage-waiting time by taking into account the obtained scanning distance.

In the fourth embodiment, substantially similar to the third embodiment, based on printing data for each line (each path), one of full-column setting data, half-column setting data and one-third-column setting data are respectively used. These three setting data are table data, respectively. The three setting data are stored in the ROM 34 as maintenance setting data, respectively.

The full-column setting data are adapted to be used when a first-jetting position of the recording head 4 during the current recording operation after the maintenance operation is located in a range between a substantially center position (half-column) of the objective recording area in the main scanning direction and the end position X (last-column) in the objective recording area furthest away from the waiting position.

The half-column setting data are adapted to be used when a first-jetting position of the recording head 4 during the current recording operation is located in a range between a substantially one-third position (one-third-column) of the objective recording area in the main scanning direction and the substantially center position (half-column) of the objective recording area in the main scanning direction.

The one-third-column setting data are adapted to be used when a first-jetting position of the recording head 4 during the current recording operation is located in a range to the substantially one-third position (one-third-column) of the objective recording area in the main scanning direction.

For example, the first-jetting position of the recording head 4 can be obtained from the printing data developed in the RAM 33.

According to the respective setting data, the execution amount of the maintenance operation is proportional to the carriage-waiting time. That is, the execution amount of the maintenance operation is more when the carriage-waiting time is longer.

In addition, comparing the full-column setting data, the half-column setting data and the one-third-column setting data with each other, with respect to the same carriage-waiting time, the execution amount of the maintenance operation according to the full-column setting data is set most, the execution amount of the maintenance operation according to the half-column setting data is set less than that according to the full-column setting data, and the execution amount of the maintenance operation according to the one-third-column setting data is set less than that according to the half-column setting data.

The other structure is substantially the same as the third embodiment shown in FIG. 8. In the fourth embodiment, the same reference numerals correspond to the same elements as the third embodiment. The explanation of the same elements is not repeated.

The controlling part 11 of the fourth embodiment is adapted to set the execution amount of the maintenance operation, based on the above setting data, in such a manner that if the no-jetting (free-running) distance and no-jetting (free-running) time until the recording head 4 jets the first drop of the ink are shorter, the execution amount of the maintenance operation is less.

That is, if the no-jetting (free-running) distance and the no-jetting (free-running) time until the recording head 4 jets the first drop of the ink are shorter, the solvent of the ink may evaporate less. Thus, the viscosity of the ink in or near to the nozzle 17 may not tend to rise to a degree affecting the quality of the printed image. Thus, the quality of the image printed by the first-jetted drop of the ink can be ensured, even if the execution amount of the maintenance operation is set smaller.

On the other hand, if the no-jetting (free-running) distance and the no-jetting (free-running) time until the recording head 4 jets the first drop of the ink are longer, the solvent of the ink tends to evaporate more. Thus, the viscosity of the ink in or near to the nozzle 17 may tend to rise to a degree affecting the quality of the printed image. Thus, the execution amount of the maintenance operation is set larger in order to ensure the quality of the image printed by the first-jetted drop of the ink.

With respect to the capping time, the capping time according to the full-column setting data is set shortest, the capping time according to the half-column setting data is set second shortest, and the capping time according to the one-third-column setting data is set longest.

That is, if the no-jetting (free-running) distance and the no-jetting (free-running) time of the recording head 4 are longer, the capping time is set relatively short, because the first drop of the ink is liable to be jetted in a state wherein the viscosity of the ink has risen too much.

On the other hand, if the no-jetting (free-running) distance and the no-jetting (free-running) time of the recording head 4 are shorter, the capping time is set relatively long, because the first drop of the ink may be hardly jetted in a state wherein the viscosity of the ink has risen too much.

As described above, in the fourth embodiment, since the execution amount of the maintenance operation is set by taking into account the first-jetting position where the recording head 4 jets the first drop of the ink in the recording operation, a degree of evaporation of the solvent of the ink, which may be caused by a no-jetting scanning of the recording head 4, can be considered more accurately. Thus, the maintenance operation may be conducted more suitably.

As a result, when the flushing operation is conducted, the volume of the waste ink can be reduced more. When the minutely-vibrating operation is conducted, a lifetime of the piezoelectric vibrating member 21 can be extended more.

In addition, division of the respective setting data is not limited to the above embodiment, but could be set freely.

In addition, the "first drop of the ink" may mean not only the first drop of the ink for the whole recording head 4, i.e. for all the nozzles 17, but also the first drop of the ink for each of the nozzles 17. In the latter case, the execution amount of the maintenance operation may be set for each of the nozzles 17. In the case, the maintenance operation may be conducted further more suitably.

Fifth Embodiment

Figure 10:
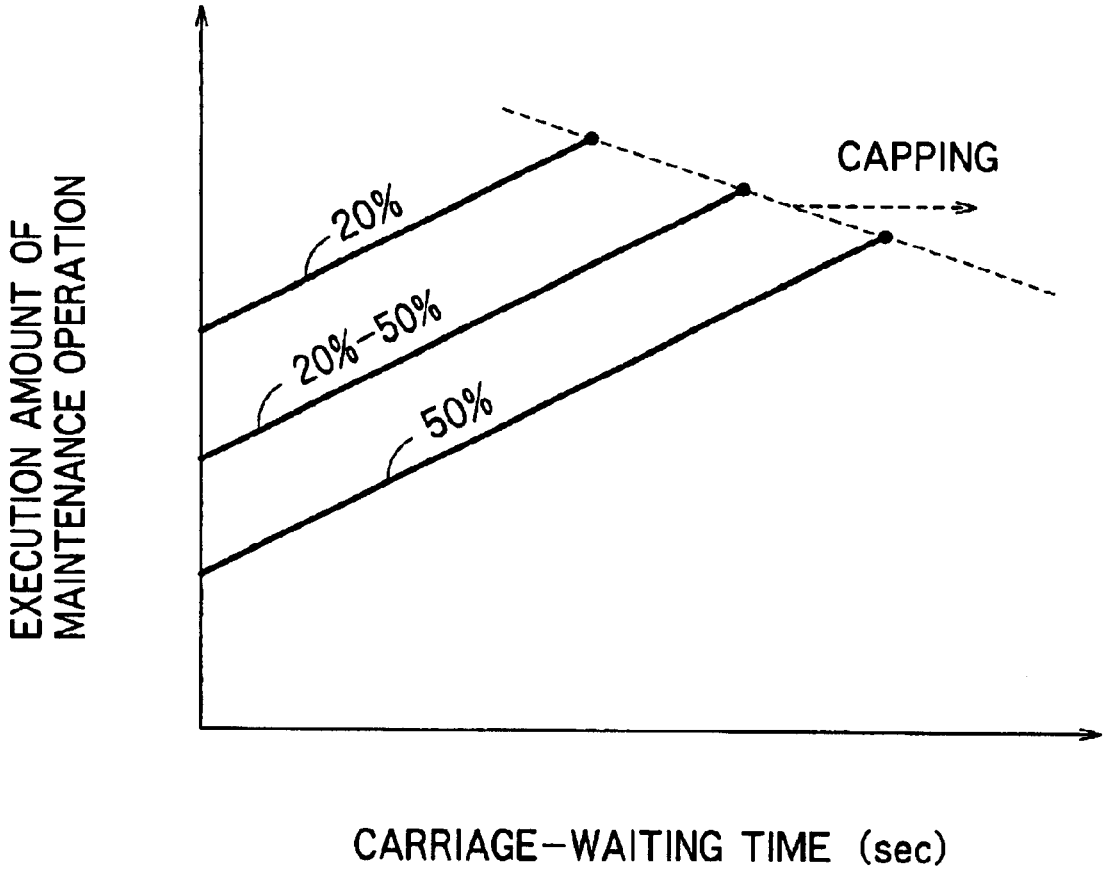
FIG. 10 is a graph for explaining an example of a relationship between waiting times and execution amounts of a maintenance operation when proportions of ink jetted in a recording operation are taken into consideration.

A fifth embodiment of the invention is now explained. FIG. 10 is a graph for explaining a relationship between carriage-waiting times and execution amounts of maintenance operation (flushing-shot numbers or numbers of times of minutely-vibrating) and a relationship between carriage-waiting times and capping times in the fifth embodiment. The controlling part 11 of the fifth embodiment sets the execution amount of the maintenance operation by taking into account ink-jetting ratio (print duty) in the recording operation. The print duty means a ratio of recording dots, that is, a ratio of the number of dots that are actually recorded to the total number of dots that can be recorded in one scanning movement.

In detail, in the fifth embodiment, based on printing data for each line (each path), one of 20% setting data, 20%–50% setting data and 50% setting data are respectively used. These three setting data are table data, respectively. The three setting data are stored in the ROM 34 as maintenance setting data, respectively.

The 20% setting data are adapted to be used when a print duty of the previous recording operation is not more than 20%.

The 20%–50% setting data are adapted to be used when a print duty of the previous recording operation is more than 20% and less than 50%.

The 50% setting data are adapted to be used when a print duty of the previous recording operation is not less than 50%.

For example, when the number of the nozzles 17 is 64 and the number of dots in the main scanning direction is 1000, the total number of dots is 64000 (64×1000). In the case, when the number of dots that have been actually recorded is 12800, the print duty is 20%. Similarly, when the number of dots that have been actually recorded is 32000, the print duty is 50%.

For example, the number of dots that have been actually recorded can be obtained from the printing data (dot-pattern-data) developed in the RAM 33.

According to the respective setting data, the execution amount of the maintenance operation is proportional to the carriage-waiting time. That is, the execution amount of the maintenance operation is more when the carriage-waiting time is longer.

In addition, comparing the 20% setting data, the 20%–50% setting data and the 50% setting data with each other, with respect to the same carriage-waiting time, the execution amount of the maintenance operation according to the 20% setting data is set most, the execution amount of the maintenance operation according to the 20%–50% setting data is set less than that according to the 20% setting data, and the execution amount of the maintenance operation according to the 50% setting data is set less than that according to the 20%–50% setting data.

The other structure is substantially the same as the second embodiment shown in FIG. 7. In the fifth embodiment, the same reference numerals correspond to the same elements as the second embodiment. The explanation of the same elements is not repeated.

The controlling part 11 of the fifth embodiment is adapted to set the execution amount of the maintenance operation, based on the above setting data, in such a manner that if a ratio of recording dots (print duty) of the previous recording operation is higher, the execution amount of the maintenance operation is less.

A higher print duty of the previous recording operation means that a frequency of jetting a drop of the ink from the respective nozzles 17 was higher on the average. That is, in this case, the viscosity of the ink in or near to the nozzle 17 may not tend to rise to a degree affecting the quality of the printed image. Thus, the quality of the printed image in the current recording area can be ensured, even if the execution amount of the maintenance operation is set smaller.

On the other hand, a lower print duty of the previous recording operation means that a frequency of jetting a drop of the ink from the respective nozzles 17 was lower on the average. That is, in this case, the viscosity of the ink in or near to the nozzle 17 may tend to rise to a degree affecting the quality of the printed image. Thus, the execution amount of the maintenance operation is set relatively large, in order to ensure the quality of the printed image in the current recording area.

With respect to the capping time, the capping time according to the 20% setting data is set shortest, the capping time according to the 20%–50% setting data is set second shortest, and the capping time according to the 50% setting data is set longest.

That is, if a print duty of the previous recording operation is lower, the viscosity of the ink in or near to the nozzle 17 may rise to a degree affecting the quality of the printed image in a relatively shorter time. Thus, the capping time is set relatively short in order to ensure the quality of the printed image even at an end position in the current recording area.

On the other hand, if a print duty of the previous recording operation is higher, the viscosity of the ink in or near to the nozzle 17 may rise to a degree affecting the quality of the printed image in a relatively longer time. Thus, the quality of the printed image at the end position in the current recording area can be ensured, even if the capping time is set relatively long.

In addition, in the fifth embodiment, the execution amount of the maintenance operation can be set by taking into account the print duty of the recording head 4 in the current recording operation, instead of the print duty of the recording head 4 in the previous recording operation.

That is, a higher print duty of the current recording operation means that a frequency of jetting a drop of the ink from the respective nozzles 17 is higher on the average. That is, in this case, the viscosity of the ink in or near to the nozzle 17 may not tend to rise to a degree affecting the quality of the printed image. Thus, the quality of the printed image in the current recording area can be ensured, even if the execution amount of the maintenance operation is set smaller.

On the other hand, a lower print duty of the current recording operation means that a frequency of jetting a drop of the ink from the respective nozzles 17 is lower on the average. That is, in this case, the viscosity of the ink in or near to the nozzle 17 may tend to rise to a degree affecting the quality of the printed image. Thus, the execution amount of the maintenance operation is set relatively large, in order to ensure the quality of the printed image in the current recording area.

Similarly, the respective capping times can be set by taking into account the print duty in the current recording operation.

That is, if a print duty of the current recording operation is lower, no-jetting (free-running) distance and no-jetting (free-running) time until a first drop of the ink is jetted in the current recording operation may be longer. Thus, the capping time is set relatively short, in order to ensure the quality of the image printed by the first drop of the ink.

On the other hand, if a print duty of the current recording operation is higher, no-jetting (free-running) distance and no-jetting (free-running) time until a first drop of the ink is jetted in the current recording operation may be shorter. Thus, the quality of the image printed by the first drop of the ink can be ensured, even if the capping time is set relatively long.

In addition, it is also effective to set the execution amount of the maintenance operation by taking into account both of the print duty in the previous recording operation and the print duty in the current recording operation. For example, an average of the print duty in the previous recording operation and the print duty in the current recording operation can be used. Alternatively, the smaller one of the print duty in the previous recording operation and the print duty in the current recording operation can be used.

As described above, in the fifth embodiment, since the execution amount of the maintenance operation is set by taking into account the print duty in the recording operation, a frequency of jetting a drop of the ink in the recording operation can be considered. Thus, the maintenance operation may be conducted more suitably.

As a result, when the flushing operation is conducted, the volume of the waste ink can be reduced. When the minutely-vibrating operation is conducted, the lifetime of the piezoelectric vibrating member 21 can be extended more.

In addition, the division of the respective setting data is not limited to the above embodiment, but could be freely set.

In addition, the "print duty" may mean not only the print duty for the whole recording head 4, i.e. for all the nozzles 17, but also the print duty for each of the nozzles 17. In the latter case, the execution amount of the maintenance operation may be set for each of the nozzles 17. In that case, the maintenance operation may be conducted even further suitably.

In the above embodiments, the controlling part 11 can set the execution amount of the maintenance operation by taking into account a kind (characteristic) of ink used for the recording operation. Thus, it can be considered that the degree of increase in the viscosity of the ink, which may be caused by evaporation of the solvent of the ink, depends on the kind of the ink.

For example, with respect to ink of a dark color such as black, the viscosity of the ink may tend to rise by evaporation of the solvent of the ink. On the other hand, with respect to ink of a light color such as yellow, light magenta or light cyan, the viscosity of the ink may not tend to rise by evaporation of the solvent of the ink so much. In addition, with respect to ink made of a pigment, the viscosity of the ink may tend to rise by evaporation of the solvent of the ink. On the other hand, with respect to ink made of a dye, the viscosity of the ink may not tend to rise by evaporation of the solvent of the ink so much.

Thus, the execution amount of the maintenance operation for the ink of the dark color may be set larger than that for the ink of the light color. Similarly, the execution amount of the maintenance operation for the ink made of the pigment may be set larger than that for the ink made of the dye. Thus, even if the degree of increase in the viscosity of the ink depends on the kind of the ink, the maintenance operation may be conducted suitably for the ink.

In detail, when a head unit uses ink of a light color such as yellow, light magenta or light cyan, a coefficient is set as "1". Then, the maintenance operation may be conducted according to just the execution amount of the maintenance operation, which has been set based on the carriage-waiting time of the recording head 4 or the like.

In addition, when a head unit uses ink of a has light color such as magenta or cyan, the coefficient is set as "2". Then, the maintenance operation may be conducted according to twice the execution amount of the maintenance operation set based on the carriage-waiting time of the recording head 4 or the like.

In addition, when a head unit uses ink of a dark color such as black, the coefficient is set as "3". Then, the maintenance operation may be conducted according to three times the execution amount of the maintenance operation set based on the carriage-waiting time of the recording head 4 or the like.

As described above, if the execution amount of the maintenance operation is set by taking into account the kind of ink, characteristic of the ink can be considered and the maintenance operation may be conducted more suitably.

In addition, in the above embodiments, the controlling part 11 can set the execution amount of the maintenance operation by taking into account a state of the environment where the ink-jetting recording apparatus 1 is used. The state of environment may include the temperature thereof and/or humidity thereof. Thus, it can be considered that the degree of evaporation of the solvent of the ink depends on the temperature and/or the humidity.

Figure 11:
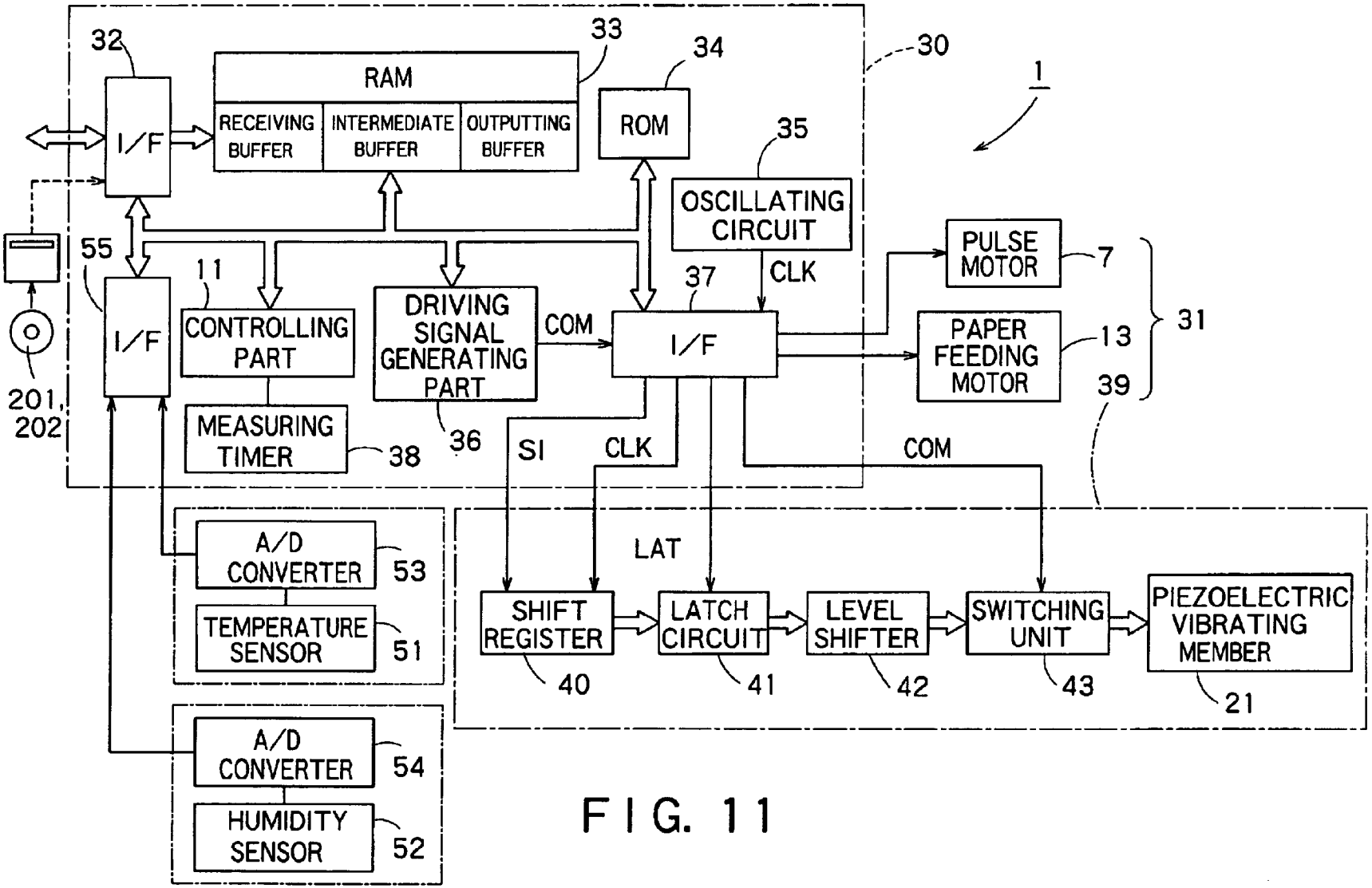
FIG. 11 is a schematic block diagram for explaining an electric structure of the recording head when the ink-jetting recording apparatus has a temperature sensor for detecting a temperature of the environment where the ink-jetting recording apparatus is used and a humidity sensor for detecting the humidity thereof.

In this case, as shown in FIG. 11, a temperature sensor 51 for detecting the temperature of the environment where the ink-jetting printer 1 is used and a humidity sensor 52 for detecting the humidity of the environment are provided as sensors for detecting the state of the environment. An analogue temperature signal detected by the temperature sensor 51 and an analogue humidity signal detected by the humidity sensor 52 are transferred to A/D converters 53 and 54, respectively. Then, the analogue signals are converted into digital signals by the A/D converters 53 and 54, respectively. The digital signals are inputted to the printer-controller 30 as environmental information via a sensor-interface 55.

The controlling part 11 can set the execution amount of the maintenance operation by taking into account the inputted environmental information (temperature information and humidity information).

Figure 12:
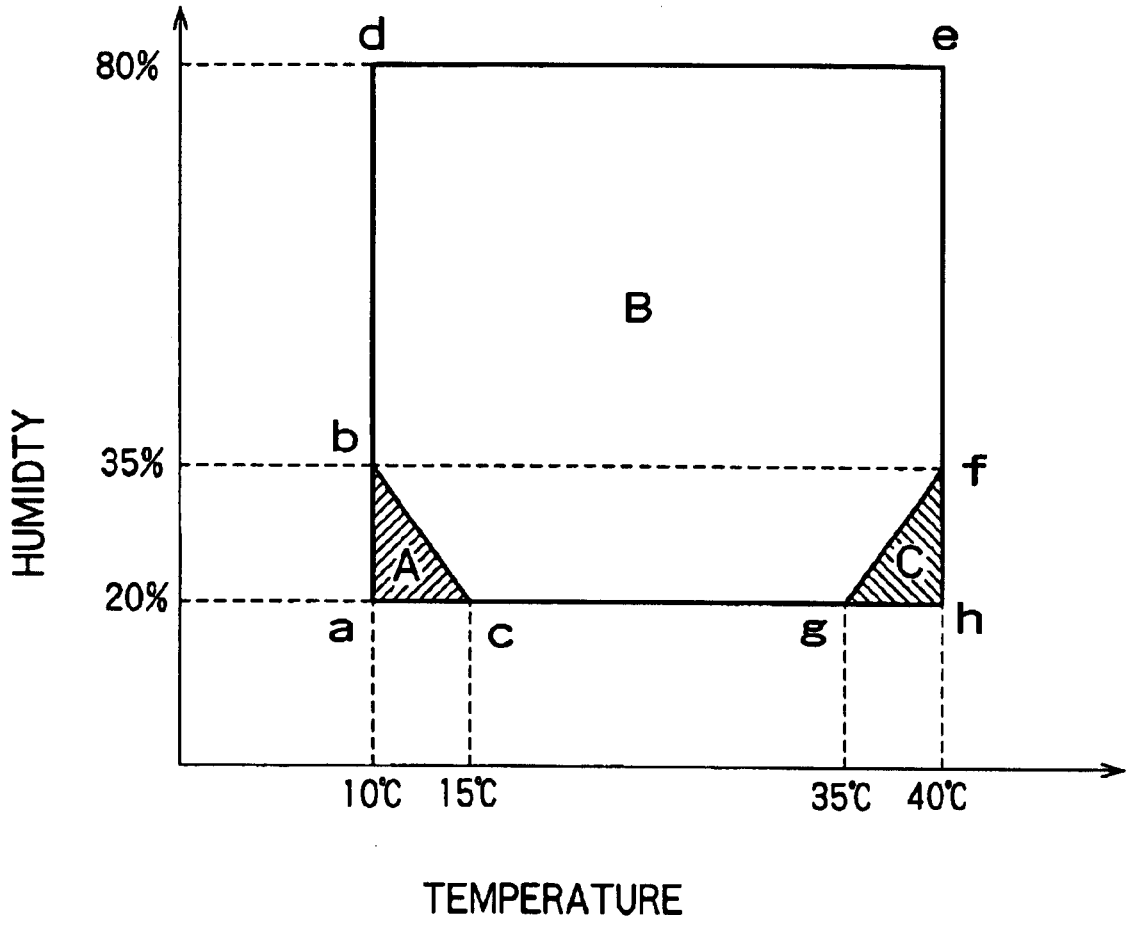
FIG. 12 is a graph for explaining an example of a relationship between combinations of the temperature and the humidity of the environment and conditions for setting coefficients.

For example, as shown in FIG. 12, based on the inputted environmental information, the state of the environment may be classified into a low-temperature and low-humidity area A, a normal area B or a high-temperature and low-humidity area C. A coefficient may be set for each of the areas as described below.

In the case shown in FIG. 12, the low-temperature and low-humidity area A is a triangular area defined by three points of a point a where the temperature is 10° C. and the humidity is 20% , a point b where the temperature is 10° C. and the humidity is 35% and a point c where the temperature is 15° C. and the humidity is 20%.

The normal area B is a home-plate-like area defined by six points of the point b where the temperature is 10° C. and the humidity is 35%, a point d where the temperature is 10° C. and the humidity is 80%, a point e where the temperature is 40° C. and the humidity is 80%, a point f where the temperature is 40° C. and the humidity is 35%, a point g where the temperature is 35° C. and the humidity is 20% and the point c where the temperature is 15° C. and the humidity is 20%.

The high-temperature and low-humidity area C is a triangular area defined by three points of the point g where the temperature is 35° C. and the humidity is 20% , the point f where the temperature is 40° C. and the humidity is 35% and a point h where the temperature is 40° C. and the humidity is 20%.

When the state of the environment is classified into the normal area B, since the solvent of the ink may not evaporate so much, a coefficient is set as "1". Then, the maintenance operation may be conducted according to just the execution amount of the maintenance operation, which has been set based on the carriage-waiting time of the recording head 4 or the like.

When the state of the environment is classified into the low-temperature and low-humidity area A or the high-temperature and low-humidity area C, the viscosity of the ink in or near to the nozzle 17 may tend to rise. That is, with respect to the humidity, the solvent of the ink may evaporate more when the humidity is lower. In addition, with respect to the temperature, the solvent of the ink may evaporate more when the temperature is higher and the viscosity of the ink itself may tend to rise if the temperature is lower. Thus, in these cases, the coefficient is set as "2". Then the maintenance operation may be conducted according to twice the execution amount of the maintenance operation set based on the carriage-waiting time of the recording head 4 or the like.

As described above, if the execution amount of the maintenance operation is set by taking into account the state of the environment where the ink-jetting printer 1 is used, the degree of evaporation of the solvent of the ink can be considered more and the maintenance operation may be conducted more suitably.

Although the inkjetting printer 1 shown in FIG. 11 is provided with both of the temperature sensor 51 and the humidity sensor 52, it is possible to provide only one of the temperature sensor 51 and the humidity sensor 52. In addition, any other sensor for detecting the state of the environment may be provided, instead of or in addition to the temperature sensor 51 and the humidity sensor 52.

In addition, the above embodiments can be variously modified in a scope of claimed invention.

For example, a pressure-generating member for changing the volume of the pressure chamber 22 is not limited to the piezoelectric vibrating member 21. For example, a pressure-generating member can consist of a magnetostrictive device. In that case, the magnetostrictive device causes the pressure chamber 22 to expand and contract, and thus changes the pressure of the ink in the pressure chamber 22. Alternatively, a pressure-generating member can consist of a heating device. In that case, the heating device causes an air bubble in the pressure chamber 22 to expand and contract, thus changing the pressure of the ink in the pressure chamber 22.

In addition, as described above, the printer controller can be embodied by a computer system. A program embodying the above one or more components in a computer system, and a storage unit 201 storing the program and capable of being read by a computer, are intended to be protected by this application.

In addition, when the above one or more components may be embodied in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk or the like, but also a network for transmitting various signals.

The above description is given for the inkjetting printer 1 as a liquid jetting apparatus of a first embodiment according to the invention. However, this invention is intended to apply to general liquid jetting apparatuses widely. The liquid may be glue, nail polish or the like, instead of ink.

As described above, according to the invention, since the recovering unit is controlled based on at least a part of the time since the previous operation of the recovering unit has been completed, a maintenance operation for recovering the suitable viscosity of the liquid in the nozzle can be conducted more efficiently, depending on a state of the liquid in the nozzle.

For example, when the flushing operation of jetting out the liquid from the head outside the objective recording area is conducted, the volume of the liquid jetted during the flushing operation can be reduced to only the necessary volume. Thus, the volume of the liquid used for the recording operations can be relatively increased. That is, the liquid can be used more efficiently. In addition, a collecting unit for collecting the liquid jetted during the flushing operation can have only a smaller capacity.

Alternatively, when the minutely-vibrating operation of changing the pressure of the liquid in the pressure chamber, not jetting out the liquid, and causing a meniscus of the liquid to minutely vibrate, is conducted, the number of times the pressure-generating member is actuated during the minutely-vibrating operation can be reduced to only a necessary number of times. Thus, the lifetime of the pressure-generating member can be extended.

What is claimed is:

1. A liquid jetting apparatus comprising:

a head having a nozzle, adapted to receive jetting data corresponding to one scanning movement in a main scanning direction, a head-scanning mechanism for moving the head in the main scanning direction after the head has received the jetting data, a recovering unit for recovering a suitable viscosity of liquid in the nozzle from an increased viscosity thereof, a measuring timer for measuring at least a part of a time since a previous operation of the recovering unit has been completed, and a controller for controlling the recovering unit based on the time measured by the measuring timer, wherein:

the head-scanning mechanism is adapted to move the head from a waiting position in the main scanning direction after the head has received the jetting data, and to move back the head to the waiting position again, and the measuring timer is adapted to measure a time since the head has been moved back to the waiting position again after being moved in the main scanning direction until the head completes receiving the jetting data.

2. A liquid jetting apparatus comprising:

a head having a nozzle, adapted to receive jetting data corresponding to one scanning movement in a main scanning direction, a head-scanning mechanism for moving the head in the main scanning direction after the head has received the jetting data, a recovering unit for recovering a suitable viscosity of liquid in the nozzle from an increased viscosity thereof, a measuring timer for measuring at least a part of a time since a previous operation of the recovering unit has been completed, and a controller for controlling an amount of execution of operation of the recovering unit based on both the time measured by the measuring timer and the jetting data.

3. A liquid jetting apparatus according to claim 2, wherein: the head-scanning mechanism is adapted to not move the head to an area over a position to which a last drop of the liquid is jetted in the one scanning movement in the main scanning direction, and the controller is adapted to control the recovering unit in dependence on a distance which the head is moved in a next scanning movement in the main scanning direction, based on the jetting data corresponding to the next scanning movement.

4. A liquid jetting apparatus according to claim 2, wherein:

the head-scanning mechanism is adapted to not move the head to an area over a position to which a last drop of the liquid is jetted in the one scanning movement in the main scanning direction, and the controller is adapted to control the recovering unit in dependence on a distance for which the head has been moved in a previous scanning movement in the main scanning direction.

5. A liquid jetting apparatus according to claim 2, wherein:

the controller is adapted to control the recovering unit in dependence on a distance which the head is to be moved until a first drop of the liquid is jetted in a next scanning movement in the main scanning direction based on the jetting data corresponding to the next scanning movement.

6. A liquid jetting apparatus according to claim 2, wherein:

the head has a plurality of nozzles, the recovering unit is adapted to recover a suitable viscosity of liquid in each of the plurality of nozzles from an increased viscosity thereof, and the controller is adapted to control the recovering unit in dependence on respective distances for which the head is to be moved until respective first drops of the liquid are jetted from the respective nozzles in a next scanning movement in the main scanning direction, based on the jetting data corresponding to the next scanning movement.

7. A liquid jetting apparatus according to claim 2, wherein: the controller is adapted to control the recovering unit in dependence on a proportion of the liquid jetted in a previous scanning movement in the main scanning direction.

8. A liquid jetting apparatus according to claim 2, wherein:

the head has a plurality of nozzles, the recovering unit is adapted to recover a suitable viscosity of liquid in each of the plurality of nozzles from an increased viscosity thereof, and the controller is adapted to control the recovering unit in dependence on respective proportions of the liquid jetted from the respective nozzles in a previous scanning movement in the main scanning direction.

9. A liquid jetting apparatus according to claim 2, wherein:

the controller is adapted to control the recovering unit in dependence on a proportion of the liquid to be jetted in a next scanning movement in the main scanning direction based on the jetting data corresponding to the next scanning movement.

10. A liquid jetting apparatus according to claim 2, wherein:

the head has a plurality of nozzles, the recovering unit is adapted to recover a suitable viscosity of liquid in each of the plurality of nozzles from an increased viscosity thereof, and the controller is adapted to control the recovering unit in dependence on respective proportions of the liquid to be jetted from the respective nozzles in a next scanning movement in the main scanning direction based on the jetting data corresponding to the next scanning movement.

11. A liquid jetting apparatus according to claim 2, wherein:

the head has a plurality of nozzles in which a plurality of kinds of liquid are used, the recovering unit is adapted to recover a suitable viscosity of liquid in each of the plurality of nozzles from an increased viscosity thereof, and the controller is adapted to control the recovering unit based on characteristics of the kinds of liquid used in the nozzles.

12. A liquid jetting apparatus according to claim 2, further comprising:

a sensor for detecting a state of the environment where the liquid jetting apparatus is used, wherein the controller is adapted to control the recovering unit; based on an output from the sensor.

13. A liquid jetting apparatus according to claim 2, further comprising:

a capping unit capable of being moved between a position away from the head and a position for coming in contact with the head in order to seal the nozzle, wherein the controller is adapted to bring the capping unit in contact with the head based on the time measured by the measuring timer.

14. A liquid jetting apparatus according to claim 2, wherein:

the recovering unit is a minutely-vibrating unit for causing the liquid in the nozzle to minutely vibrate.

15. A liquid jetting apparatus according to claim 14, wherein:

the recovering unit is a flushing unit for causing the liquid in the nozzle to jet out from the nozzle outside an objective jetting area.

16. A controlling unit for controlling a liquid jetting apparatus including: a head having a nozzle, adapted to receive jetting data corresponding to one scanning movement in a main scanning direction; a head-scanning mechanism for moving the head in the main scanning direction after the head has received the jetting data; a recovering unit for recovering a suitable viscosity of liquid in the nozzle from an increased viscosity thereof; and a measuring timer for measuring at least a part of a time since a previous operation of the recovering unit has been completed;

wherein:

the controlling unit is adapted to control the recovering unit based on the time measured by the measuring timer;

the head-scanning mechanism is adapted to move the head from a waiting position in the main scanning direction after the head has received the jetting data, and to move the head back to the waiting position again, and the measuring timer is adapted to measure a time since the head has been moved back to the waiting position again after being moved in the main scanning direction until the head completes receiving the jetting data.

17. A controlling unit for controlling a liquid jetting apparatus, including: a head having a nozzle, adapted to receive jetting data corresponding to one scanning movement in a main scanning direction; a head-scanning mechanism for moving the head in the main scanning direction after the head has received the jetting data; a recovering unit for recovering a suitable viscosity of liquid in the nozzle from an increased viscosity thereof; and a measuring timer for measuring at least a part of a time since a previous operation of the recovering unit has been completed; wherein:

the controlling unit is adapted to control an amount of execution of operation of the recovering unit based on both the time measured by the measuring timer and the jetting data.

18. A controlling unit according to claim 17, wherein:

the head-scanning mechanism is adapted to not move the head to an area over a position to which a last drop of the liquid is jetted in the one scanning movement in the main scanning direction, and the controlling unit is adapted to control the recovering unit in dependence on a distance for which the head is to be moved in a next scanning movement in the main scanning direction based on the jetting data corresponding to the next scanning movement.

19. A controlling unit according to claim 17, wherein:

the head-scanning mechanism is adapted to not move the head to an area over a position to which a last drop of the liquid is jetted in the one scanning movement in the main scanning direction, and the controlling unit is adapted to control the recovering unit in dependence on a distance for which the head has been moved in a previous scanning movement in the main scanning direction.

20. A controlling unit according to claim 17, wherein:

the controlling unit is adapted to control the recovering unit in dependence on a distance for which the head is to be moved until a first drop of the liquid is jetted in a next scanning movement in the main scanning direction based on the jetting data corresponding to the next scanning movement.

21. A controlling unit according to claim 17, wherein:

the head has a plurality of nozzles, the recovering unit is adapted to recover a suitable viscosity of liquid in each of the plurality of nozzles from an increased viscosity thereof, and the controlling unit is adapted to control the recovering unit in dependence on respective distances for which the head is to be moved until respective first drops of the liquid are jetted from the respective nozzles in a next scanning movement in the main scanning direction based on the jetting data corresponding to the next scanning movement.

22. A controlling unit according to claim 17, wherein:

the controlling unit is adapted to control the recovering unit in dependence on a proportion of the liquid jetted in a previous scanning movement in the main scanning direction.

23. A controlling unit according to claim 17, wherein:

the head has a plurality of nozzles, the recovering unit is adapted to recover a suitable viscosity of liquid in each of the plurality of nozzles from an increased viscosity thereof, and the controlling unit is adapted to control the recovering unit in dependence on respective proportions of the liquid jetted from the respective nozzles in a previous scanning movement in the main scanning direction.

24. A controlling unit according to claim 17, wherein:

the controller is adapted to control the recovering unit in dependence on a proportion of the liquid to be jetted in a next scanning movement in the main scanning direction based on the jetting data corresponding to the next scanning movement.

25. A controlling unit according to claim 17, wherein:

the head has a plurality of nozzles, the recovering unit is adapted to recover a suitable viscosity of liquid in each of the plurality of nozzles from an increased viscosity thereof, and the controlling unit is adapted to control the recovering unit in dependence on respective proportions of the liquid to be jetted from the respective nozzles in a next scanning movement in the main scanning direction based on the jetting data corresponding to the next scanning movement.

26. A controlling unit according to claim 17, wherein:

the head has a plurality of nozzles in which a plurality of kinds of liquid are used, the recovering unit is adapted to recover a suitable viscosity of liquid in each of the plurality of nozzles from an increased viscosity thereof, and the controlling unit is adapted to control the recovering unit based on characteristics of the kinds of liquid used in the nozzles.

27. A controlling unit according to claim 17, wherein:

the liquid jetting apparatus further includes a sensor for detecting a state of the environment where the liquid jetting apparatus is used, and the controlling unit is adapted to control the recovering unit based on an output from the sensor.

28. A controlling unit according to claim 17, wherein:

the liquid jetting apparatus further includes a capping unit capable of being moved between a position away from the head and a position for coming in contact with the head in order to seal the nozzle, and the controlling unit is adapted to bring the capping unit in contact with the head based on the time measured by the measuring timer.

29. A storage unit capable of being read by a computer, storing a program for controlling a liquid jetting apparatus including: a head having a nozzle, adapted to receive jetting data corresponding to one scanning movement in a main scanning direction; a head-scanning mechanism for moving the head in the main scanning direction after the head has received the jetting data; a recovering unit for recovering a suitable viscosity of liquid in the nozzle from an increased viscosity thereof; and a measuring timer for measuring at least a part of a time since a previous operation of the recovering unit has been completed; wherein:

the program is adapted to control an amount of execution of operation of the recovering unit based on both the time measured by the measuring timer and the jetting data.

30. A storage unit capable of being read by a computer, storing a program including a command for controlling a second program executed by a computer system including a computer, the program being executed by the computer system to control the second program to control a liquid jetting apparatus including: a head having a nozzle, adapted to receive jetting data corresponding to one scanning movement in a main scanning direction; a head-scanning mechanism for moving the head in the main scanning direction after the head has received the jetting data; a recovering unit for recovering a suitable viscosity of liquid in the nozzle from an increased viscosity thereof; and a measuring timer for measuring at least a part of a time since a previous operation of the recovering unit has been completed; wherein:

the second program is adapted to control an amount of execution of operation of the recovering unit based on both the time measured by the measuring timer and the jetting data.

31. A liquid jetting apparatus comprising:

a head having a nozzle, adapted to receive jetting data corresponding to one scanning movement in a main scanning direction, a head-scanning mechanism for moving the head in the main scanning direction after the head has received the jetting data, a recovering unit for recovering a suitable viscosity of liquid in the nozzle from an increased viscosity thereof, and a controller for controlling the recovering unit in dependence on a distance for which the head is to be moved until a first drop of the liquid is jetted in a next scanning movement in the main scanning direction based on the jetting data corresponding to the next scanning movement.

32. A controlling unit for controlling a liquid jetting apparatus including: a head having a nozzle, adapted to receive jetting data corresponding to one scanning movement in a main scanning direction; a head-scanning mechanism for moving the head in the main scanning direction after the head has received the jetting data; and a recovering unit for recovering a suitable viscosity of liquid in the nozzle from an increased viscosity thereof; wherein:

the controlling unit is adapted to control the recovering unit in dependence on a distance for which the head is to be moved until a first drop of the liquid is jetted in a next scanning movement in the main scanning direction based on the jetting data corresponding to the next scanning movement.

* * * * *